US006702118B2

(12) United States Patent
O'Connor et al.

(10) Patent No.: US 6,702,118 B2
(45) **Date of Patent: *Mar. 9, 2004**

(54) PACKAGING A STRIP OF MATERIAL

(75) Inventors: Lawrence J. O'Connor, Winnipeg (CA); Darrell Van Mol, Winnipeg (CA)

(73) Assignee: BKI Holding Corporation, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/000,653

(22) Filed: Nov. 1, 2001

(65) Prior Publication Data

US 2002/0046549 A1 Apr. 25, 2002

Related U.S. Application Data

(60) Division of application No. 09/337,658, filed on Jun. 22, 1999, now Pat. No. 6,321,512, which is a continuation-in-part of application No. 09/263,889, filed on Mar. 8, 1999, now Pat. No. 6,293,075.

(51) Int. Cl.[7] ..... B65D 85/00

(52) U.S. Cl. ..... 206/494; 206/499; 206/597; 206/497

(58) Field of Search ..... 53/429, 436, 117, 53/527, 541, 449, 176; 206/494, 499, 597, 497; 270/39.01, 39.02, 39.03, 39.05, 40; 493/413–415

(56) References Cited

U.S. PATENT DOCUMENTS

| | | | |
|---|---|---|---|
| 32,761 | A | 7/1861 | Elliot |
| 1,029,459 | A | 6/1912 | Quigley |

(List continued on next page.)

FOREIGN PATENT DOCUMENTS

| | | |
|---|---|---|
| AT | 181590 | 4/1951 |
| AU | 22983/83 | 12/1983 |

(List continued on next page.)

OTHER PUBLICATIONS

Amborsky RT, "Alternative Means of Packaging Airlaid Webs—Spooling & Festooning Pads" pp. 1–1 paper presented on Oct. 14, 1997 at "Insight Conference" in San Antonio, Texas.

*Primary Examiner*—Stephen F. Gerrity
(74) *Attorney, Agent, or Firm*—Darby & Darby

(57) ABSTRACT

A package of strip material includes a plurality of stacks of the strip side by side where each strip forms a stacked fan folded supply of the strip which is spliced to or arranged so that it can be subsequently spliced to a next adjacent strip for supply of a continuous strip from the package. The side by side stacks are simultaneously built up from the bottom by moving a carriage back and forth below a stationary bottom surface of the stacks with the strips supplied side by side through a slot in the carriage. The stacks are supported side by side as they are built up by rigid side walls of a chute or rectangular container into which the package is to be packaged for transportation. Splice tail portions extend from the strips and are supported or arranged so that they are ready for splicing when the package is completed before transportation. Transfer of the completed stacks is effected simultaneously by a slip sheet arrangement or by moving one of the belts of the carriage as an ejection belt. A method for forming a package of a plurality of side-by-side stacks of continuous strips of material in a rectangular container is also provided. Each strip is folded back and forth about first and second fold lines to form a stack of a plurality of folded overlying strip portions which are arranged side-by-side so that the side edges are aligned. The fold lines are transverse to the strip and arranged at opposite ends of the stack. A splice tail portion extending from a first strip end portion of each stack is spliced to a second strip end portion. The stacks are compressed such that their height is equal to that of the container and the splice tail portions remain loose and uncompressed.

16 Claims, 15 Drawing Sheets

U.S. PATENT DOCUMENTS

| | | | | |
|---|---|---|---|---|
| 1,463,918 | A | | 8/1923 | Borroughs |
| 1,489,833 | A | | 4/1924 | Keller |
| 1,985,676 | A | | 12/1934 | Hand |
| 1,985,678 | A | * | 12/1934 | Hand |
| 2,384,395 | A | | 9/1945 | Payne |
| 2,425,301 | A | * | 8/1947 | Browner |
| 2,659,187 | A | | 11/1953 | Barnes |
| 3,245,680 | A | | 4/1966 | Harrison et al. |
| 3,285,405 | A | * | 11/1966 | Wanderer |
| 3,321,889 | A | | 5/1967 | Zubik et al. |
| 3,351,992 | A | | 11/1967 | Carter |
| 3,429,095 | A | * | 2/1969 | Huson |
| 3,499,261 | A | | 3/1970 | Hullhorst et al. |
| 3,627,306 | A | | 12/1971 | Affupper |
| 3,631,972 | A | * | 1/1972 | Gendron et al. |
| 3,632,103 | A | | 1/1972 | Nikitits |
| 3,673,757 | A | | 7/1972 | Willis |
| 3,697,062 | A | | 10/1972 | Mones et al. |
| 3,729,367 | A | * | 4/1973 | Shore et al. |
| 3,780,908 | A | | 12/1973 | Fitzpatrick et al. |
| 3,913,904 | A | | 10/1975 | Occhetti |
| 3,972,519 | A | | 8/1976 | Melzer |
| 4,053,151 | A | | 10/1977 | Frezza |
| 4,074,901 | A | | 2/1978 | Catallo |
| 4,097,039 | A | | 6/1978 | Fischer |
| 4,130,679 | A | | 12/1978 | Breznak et al. |
| 4,174,101 | A | | 11/1979 | Frezza |
| 4,201,029 | A | | 5/1980 | Lerner et al. |
| 4,240,854 | A | | 12/1980 | Massey et al. |
| 4,332,583 | A | | 6/1982 | Stemmler et al. |
| 4,406,650 | A | | 9/1983 | Felix |
| 4,408,666 | A | | 10/1983 | Lawson |
| 4,418,514 | A | | 12/1983 | Spann |
| 4,427,404 | A | * | 1/1984 | Yamada |
| 4,460,291 | A | | 7/1984 | Lamendour |
| 4,467,589 | A | | 8/1984 | van Maanen |
| 4,488,833 | A | | 12/1984 | Perry et al. |
| 4,493,689 | A | | 1/1985 | Affupper |
| 4,512,464 | A | | 4/1985 | Sylvester |
| 4,544,304 | A | | 10/1985 | Fisher |
| 4,547,184 | A | | 10/1985 | Bunch, Jr. |
| 4,564,184 | A | | 1/1986 | Rumpel |
| 4,573,670 | A | | 3/1986 | Felix |
| 4,597,748 | A | | 7/1986 | Wolf |
| 4,603,817 | A | | 8/1986 | O'Connor |
| 4,670,001 | A | | 6/1987 | Campbell et al. |
| 4,715,925 | A | | 12/1987 | Hofmeister et al. |
| 4,716,706 | A | | 1/1988 | Boeckmann |
| 4,730,762 | A | | 3/1988 | Felix |
| 4,737,045 | A | | 4/1988 | Koefferlein |
| 4,805,383 | A | | 2/1989 | Allwein |
| 4,815,405 | A | | 3/1989 | Young, Jr. |
| 4,824,426 | A | | 4/1989 | DuFresne |
| 4,828,540 | A | | 5/1989 | Fordyce |
| 4,829,918 | A | | 5/1989 | Young, Jr. |
| 4,846,454 | A | | 7/1989 | Parkander |
| 4,863,029 | A | * | 9/1989 | Koskol et al. |
| 4,896,475 | A | * | 1/1990 | McAvinew |
| 4,907,397 | A | | 3/1990 | Goodman |
| 4,941,374 | A | | 7/1990 | Focke |
| 5,029,828 | A | | 7/1991 | Sato et al. |
| 5,036,977 | A | * | 8/1991 | Schofield et al. |
| 5,041,074 | A | | 8/1991 | Zwimpfer |
| 5,042,789 | A | | 8/1991 | Hediger |
| 5,047,003 | A | | 9/1991 | Schmidlin et al. |
| 5,052,995 | A | | 10/1991 | Focke et al. |
| 5,064,179 | A | | 11/1991 | Martin |
| 5,085,624 | A | * | 2/1992 | Felix |
| 5,087,140 | A | | 2/1992 | Keeton et al. |
| 5,104,366 | A | | 4/1992 | Bunch |
| 5,147,273 | A | | 9/1992 | Rottmann et al. |
| 5,177,934 | A | * | 1/1993 | Yamamoto |
| 5,201,700 | A | | 4/1993 | Meschi |
| 5,205,808 | A | | 4/1993 | Gebhardt |
| 5,242,057 | A | | 9/1993 | Cook et al. |
| 5,290,226 | A | | 3/1994 | Green, Jr. |
| 5,348,527 | A | * | 9/1994 | Beckwith |
| 5,358,140 | A | * | 10/1994 | Pellegrino |
| 5,529,564 | A | | 6/1996 | Hediger |
| 5,558,318 | A | | 9/1996 | Crowley et al. |
| 5,616,113 | A | | 4/1997 | Van Den Bergh |
| 5,658,638 | A | | 8/1997 | Pottenger |
| 5,690,250 | A | | 11/1997 | Gooding, Jr. et al. |
| 5,730,695 | A | | 3/1998 | Hauschild et al. |
| 6,029,819 | A | * | 2/2000 | Jaeger et al. |
| 6,068,125 | A | * | 5/2000 | Slaters, Jr. et al. |
| 6,293,075 | B1 | * | 9/2001 | O'Connor et al. |
| 6,321,512 | B1 | * | 11/2001 | O'Connor et al. |

FOREIGN PATENT DOCUMENTS

| | | | |
|---|---|---|---|
| DE | 1141610 | | 11/1954 |
| DE | 2225061 | | 12/1973 |
| DE | 198 03 837 | A1 | 8/1999 |
| EP | 0 231 412 | A1 | 8/1987 |
| EP | 274737 | | 12/1987 |
| EP | 383501 | | 2/1990 |
| FR | 1357816 | | 7/1964 |
| GB | 883100 | | 11/1961 |
| GB | 2028774 | A | 3/1980 |
| GB | 2193734 | A | 2/1988 |
| JP | 5747638 | | 3/1982 |
| JP | 63-176257 | | 7/1988 |
| JP | 6-210494 | * | 8/1994 |
| JP | 2678390 | | 8/1998 |
| SU | 555205 | A | 4/1990 |
| WO | 9935073 | | 7/1999 |

* cited by examiner

PACKAGING A STRIP OF MATERIAL

This application is a division of Ser. No. 09/337,658, filed Jun. 22, 1999 (now U.S. Pat. No. 6,321,512).

This application is a continuation in part of application Ser. No. 09/263,889, filed Mar. 8, 1999, now a U.S. Pat. No. 6,293,075 issued on Sep. 25, 2001.

This invention relates to a method for forming a strip of material and to a product formed from the strip.

This application is related to co-pending applications on this subject matter as follows:

Ser. No. 08/876,402 filed Jun. 16, 1997, now U.S. Pat. No. 5,921,064, issued on Jul. 13, 1999;

Ser. No. 08/878,826 filed Jun. 19, 1997, now U.S. Pat. No. 6,035,608, issued on Mar. 14, 2000;

Ser. No. 08/906,291 filed Aug. 5, 1997, now abandoned;

Ser. Nos. 08/939,815, now U.S. Pat. No. 5,956,926, issued on Sep. 28, 1999; 08/939,444, now abandoned, and 08/939,881, now abandoned, all filed Sep. 29, 1997;

Ser. No. 08/948,258 filed Oct. 9, 1997, now abandoned.

Ser. No. 08/889,737 filed July 8th 1997, now U.S. Pat. No. 5,927,051, issued on Jul. 27, 1999 and Ser. No. 09/081,826 filed May 20, 1998, now U.S. Pat. No. 5,987,851, issued on Nov. 23, 1999.

The disclosures of all of the above applications is incorporated herein by reference and is also published on Dec. 30, 1998 in International application No. PCT/CA98/00592 publication No. 98/58864.

BACKGROUND OF THE INVENTION

Previously packages of a continuos strip of material have been formed using a technique known as "festooning" in which the strip is folded back and forth to lay a series of strip portions back and forth with each portions being folded relative to the next about a line transverse to the strip. The technique of festooning has been available for many years and is used in packaging many different types of material but particularly material of a fibrous nature such as fabric, non-woven strips and the like. In this technique, the strip is conventionally guided into a receptacle such as a cardboard box while a first reciprocating movement causes portions of the strip to be laid across the receptacle and folded back and forth and a second reciprocating movement causes the positions of the portions to be traversed relative to the receptacle transversely to the portions. Normally the receptacle comprises a rigid rectangular container at least partly of cardboard having a base and four upstanding sides.

In an alternative arrangement the strip is packaged by rolling the strip into a cylindrical pad having a width equal to the width of the strip or is wound into a cylindrical traverse package having a width greater than the width of the strip.

In all of these arrangements, the intention is to limit the number of splices in the strip since these slices cause the material at or on either side of the splice to be scrapped. Splices are necessary in joining the master rolls from which the strips are slit.

The above applications disclose details of an improved method of forming a package of a strip for supply of the strip comprising:

providing a strip having a first side edge, a second side edge, a first surface and a second surface:

forming a plurality of stacks of the strip;

in each of the stacks repeatedly folding the strip back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

arranging me strip portions thus to form a plurality of first fold lines at one end of the stack and a plurality of second fold lines at an opposed end of the stack;

arranging the strip portions thus such that the first surface of each strip portion lies directly in contact with the first surface of one next adjacent portion and such that the second surface of each portion lies directly in contact with the second surface of the other next adjacent portion;

arranging the strip portions with the first side edges thereof lying directly on top of and aligned with the first side edges of others of the strip portions of the stack and with the second side edges thereof lying directly on top of and aligned with the second side edges of others of the strip portions;

arranging the strip portions of the stack with the first and second surfaces thereof generally parallel to a top surface and bottom surface of the stack;

arranging the strip so as to be continuous through the stack between a bottom strip portion and a top strip portion;

arranging the stacks side by side without intervening rigid container walls;

and providing at the top and bottom of each stack a tail portion of the strip which is available for splicing to the tail portion of the strip of the next adjacent stack.

In most cases the entire top surface and the entire bottom surface of each of the stacks are placed under compression in a direction at right angles to the top surface and the bottom surface of the stack and the package is engaged by a packaging material which maintains the compression.

One problem which arises in the manufacture of a package of this type is in simultaneously folding the strips side by side to form simultaneously the side by side stacks of the finished package. For economic production, it is highly desirable that the folding is effected at a relatively high rate generally greater than 500 feet per minute, preferably of the order of 750 feet per minute and even up to 1200 feet per minute at which some lines currently operate. These higher rates allows the folding machine to be provided direly behind the manufacturing line thus avoiding necessity for packaging the material in web form prior to manufacture of the package of the type set forth above.

One arrangement for folding paper sheet into a single stack of zig zag folded sheet portion is shown in U.S. Pat. No. 4,573,670 (Felix) assigned to Jos. Hunkeler A G of Switzerland. Later U.S. Pat. No. 5,085,624 (Felix) and U.S. Pat. No. 5,042,789 (Hediger) are also relevant to this machine.

In this machine there is provided a carriage which moves horizontally back and forth underneath a stack of the sheets of paper. The carriage defines a transverse slot which is moved back and forth underneath the stack so that a supply of the paper sheet fed from beneath the stack through the slot is folded back and forth as the slot is moved back and forth under the package.

The package is supported on two belts each of which wraps around a respective one of a pair of rollers defining a slot. The upper run of each of the belts is thus in effect stationary holding and supporting the package in stationary position as the slot defined by the belts in the roller is moved back and forth. This arrangement as shown in the patents has led to a successful machine which folds paper sheet into a single stack at a relatively slow speed of the order of 200 feet per minute.

This machine is however unsuitable for and has not been in any way used for the manufacture of packages defined by a plurality of side by side stacks of strip material of relatively narrow width.

SUMMARY OF THE INVENTION

It is one object of the present invention, therefore, to provide an improved arrangement for forming a package of the type generally described above and an improved package formed by the method.

According to a first aspect of the invention there is provided a package comprising:

a strip having a first side edge, a second side edge, a first surface and a second surface;

a plurality of stacks of the strip;

in each stack the strip being folded repeatedly back and for so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions of each stack being arranged to form a plurality of first fold lines at one fold end of the stack and a plurality of second fold lines at an opposed fold end of the stack;

the strip portions of each stack being arranged such that the first surface of each strip portion lies dirty in contact with the first surface of one next adjacent strip portion and such that the second surface of each strip portion lies directly in contact with the second surface of the other next adjacent strip portion;

the strip portions of each stack being arranged with the first side edges thereof lying directly on top of and aligned with the first side edges of others of the strip portions of the stack and with the second side edges thereof lying directly on top of and aligned with the second side edges of others of the strip portions of the stack;

the strip portions of each stack being continuous through the stack between a bottom strip portion and a top strip portion;

the plurality of stacks being arranged side by side with the side edges of the strip portions of each stack adjacent the side edges of a next adjacent stack;

the plurality of stacks thus defining two fold ends of the package containing the fold ends of the stacks and two sides of the package defined by outwardly facing sides of two outermost stacks;

each stack having a splice tail portion extending from a bottom end strip portion of the stack and spliced to a top end strip portion of a next adjacent stack with each splice tail portion extending along one of the fold ends of the stack;

the package being contained within a rectangular container having four rigid side walls each adjacent a respective one of the two sides and the two fold ends of the package;

the stacks having an uncompressed height greater than that of container such that, when uncompressed, a portion of the stacks is exposed above a top edge of the container;

the stacks being compressed in a direction at right angles to the surfaces of the strip portions such that the height of the stacks is reduced from the uncompressed height to a compressed height equal to the height of the container and such that the splice tail portions thus are loose;

said one fold end of the stack being spaced from the adjacent rigid wall of the container by sufficient space to receive the loose splice tail portion therebetween without compression thereof.

Preferably each of the splices between the splice tell portion and the top strip portion is arranged either at the top end of the stacks such that the loose splice tail portion is free from a splice or in the portion of the stacks which is exposed above the top edge of the container when the stacks are uncompressed.

Preferably each of the splices between the splice tail portion and the top strip portion is arranged at the top end of the stacks such that the loose splice tail portion is free from a splice.

Preferably the splice tail portions for alternate stacks are arranged al alternate fold ends of the package.

Preferably the container comprises a pre-formed structure including a sleeve portion defining said four rigid walls and a bottom wall.

Preferably the container is dosed by a top cover and wherein the package is maintained compressed by a strapping wrapped around the container and over the top cover.

Preferably the strip is compressible and wherein the amount of compression is sufficient to compress the thickness of each strip portion of each stack.

According to a second aspect of the invention there is provided a package comprising:

a strip having a first side edge, a second side edge, a first surface and a second surface;

a plurality of sack of the strip;

in each stack the strip being folded repeatedly back and forth so the the stack contains a plurality of folded overhang strip portions of the strip, with each strip portion being folded relative to one next adjacent strip portion about a first fold line transverse to the strip and relative to a second next adjacent strip portion about a second fold line transverse to the strip and spaced from the first fold line;

the strip portions of each stack being arranged to form a plurality of first fold lines at one fold end of the stack and a plurality of second fold lines at an opposed fold end of the stack;

the strip portions of each stack being arranged such that the first surface of each strip portion lies dirty in contact with the first surface of one next adjacent strip portion and such that the second surface of each strip portion lies directly in contact with the second surface of the other next adjacent strip portion;

the strip portions of each stack being arranged with the first side edges thereof lying directly on top of and aligned with the first side edges of others of the strip portions of the stack and with the second side edges thereof lying directly on top of and aligned with the second side edges of others of the strip portions of the stack;

the strip portions of each stack being continuous through the stack between a bottom strip portion and a top strip portion;

the plurality of stacks being arranged side by side with the side edges of the strip portions of each stack adjacent the side edges of a next adjacent stack;

the plurality of stacks thus defining two fold ends of the package containing the fold ends of the stacks and two sides of the package defined bay outwardly facing sides of two outermost stacks;

each stack having a splice tail portion extending from a bottom end strip portion of the stack and spliced to a top end strip portion of a next adjacent stack with the splice tail portion extending along one of the fold ends of the stack;

the package being contained within a container including a sleeve portion defining upstanding four walls with a top edge and a bottom wall, such that each of the four walls lies adjacent a respective one of the two sides and the two fold ends of the package, together with a cover portion covering the top edge;

the stacks having an uncompressed height greater than that of container such that, when uncompressed, a portion of the stacks is exposed above al top edge of the four walls of the container;

the stacks being compressed in a direction at right angles to the surfaces of the strip portions such that the height of the stacks is reduced from the uncompressed height to a compressed height equal to the height of the container;

each of the splices between the splice tail portion and the top strip portion being arranged either at the top end of the stacks such that the loose splice tail portion is free from a splice or in the portion of the stacks which is exposed above the top edge of the container when the stacks are uncompressed.

According to a third aspect of the Invention there is provided a package comprising:

a strip having a first side edge, a second side edge, a first surface and a second surface;

a plurality of stacks of the strip;

in each stack the strip being folded repeatedly back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions of each stack being arranged to form a plurality of first fold lines at one fold end of the stack and a plurality of second fold lines at an opposed fold end of the stack;

the strip portions of each stack being arranged such that the first surface of each strip portion lies directly in contact with the first surface of one next adjacent strip portion and such that the second surface of each strip portion lies directly in contact with the second surface of the other next adjacent strip portion;

the strip portions of each stack being arranged with the first side edges thereof lying directly on top of and aligned with the first side edges of others of this strip portions of the stack and with the second side edges thereof lying directly on top of and aligned with the second side edges of others of the strip portions of the stack;

the strip portions of each stack being continuous through the stack between a bottom strip portion and a top strip portion;

the plurality of stacks being arranged side by side with the side edges of the strip portions of each stack adjacent the side edges of a next adjacent stack;

the plurality of stacks thus defining two fold ends of the package containing the fold ends of the stacks and two sides of the package defined by outwardly facing sides of two outermost stacks;

each stack having a splice tail portion extending from a bottom end strip portion of the stack and spliced to a top end strip portion of a next adjacent stack with the splice tail portion extending along one of the fold ends of the stack;

the package being contained within a container inducing a sleeve portion defining upstanding four rigid walls with a top edge and a rigid bottom wall, such that each of the four walls lies adjacent a respective one of the two sides and the two fold ends of the package, together with a rigid cover portion covering the top edge;

each of the splices between the splice tail portion and the top strip portion being arranged at the top end of the stacks such that the loose splice tail portion is free from a splice.

According to a fourth aspect of the invention there is provided a method of forming a package of a strip comprising:

forming a plurality of stacks of the strip;

the strip having a first side edge, a second side edge, a first surface and a second surface;

in each stack repeatedly folding the strip back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

arranging the strip portions of each stack to form a plurality of first fold lines at one fold end of the stack and a plurality of second fold lines at an opposed fold end of the stack;

arranging the strip portions of each stack such that the first surface of each strip portion lies directly in contact with the first surface of one next adjacent strip portion and such that the second surface of each strip portion lies directly in contact with the second surface of the other next adjacent strip portion;

arranging the strip portions of each stack with the first side edges thereof lying directly on top of an aligned with the first side edges of others of the strip portions of the stack and with the second side edges thereof lying directly on top of and aligned with the second side edges of others of the strip portions of the stack;

arranging the strip portions of each stack with the strip of each stack continuous through the stack between a first end strip portion and a second end strip portion;

and arranging the plurality of stacks side by side with the side edges of the strip portions of each stack adjacent the side edges of a next adjacent stack;

the plurality of stacks thus defining two fold ends of the package containing the fold ends of the stacks and two sides of the package defined by outwardly facing sides of two outermost stacks;

the plurality of stacks being arranged to define first and second strip ends of the package with the first strip end containing all of the first end strip portions of the stacks and the second strip end containing all of the second end strip portions of the stacks;

providing for each stack a splice tail portion extending from a first end strip portion of the stack;

inserting the plurality of stacks into a rectangular container having four rigid side walls each adjacent a respective one of the two sides and the two fold ends of the package;

the height of the stacks between the first and second strip ends being greater than the height of the container such that an exposed portion of the stacks is exposed beyond an edge of the container;

effecting a splice of the splice tail portion to a second end strip portion of a next adjacent stack with each splice tail portion extending along one of the fold ends of the stack;

compressing the stacks such that the stacks are decreased in height to a height equal to the height of the container and such that the splice tail portions thus become loose;

and providing between the rigid wall of the container and said one fold end of the package sufficient space to receive the loose splice tail portion without compression thereof.

According to a fifth aspect of the invention there is provided a method of forming a package of a strip comprising:

forming a plurality of stacks of the strip;

the strip having a first side edge, a second side edge, a first surface and a second surface;

in each stack repeatedly folding the strip back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

arranging the strip portions of each stack to form a plurality of first fold lines at one end of the stack and a plurality of second fold lines at an opposed end of the stack;

arranging the strip portions of each stack such that the first surface of each strip portion lies directly in contact with the first surface of one next adjacent strip portion and such that the second surface of each strip portion lies directly in contact with the second surface of the other next adjacent strip portion;

arranging the strip portions of each stack with the first side edges thereof lying directly on top of and aligned with the first side edges of others of the strip portions of the stack and with the second side edges thereof lying directly on top of and aligned with the second side edges of others of the strip portions of the stack;

arranging the strip portions of each stack with the strip of each stack continuous through the stack between a first end strip portion and a second end strip portion;

arranging the plurality of stacks side by side with the side edges of the strip portions of each stack adjacent the side edges of a next adjacent stack;

the plurality of stacks thus defining two fold ends of the package containing the fold ends of the stacks and two sides of the package defined by outwardly facing sides of two outermost stacks;

the plurality of stacks being arranged to define first and second strip ends of the package with the first strip end containing all of the first end strip portions of the stacks and the second strip end containing all of the second end strip portions of the stacks;

wherein the step of folding the strip in the stacks includes:

simultaneously supplying the strips side by side;

feeding the side by side strips through a guide slot in a carriage located underneath the stacks and moveable parallel to a one strip end surface of the stacks and moving the slot back and forth between the ends of the stacks so as to form the stacks on top of the carriage;

providing a container for receiving the side by side stacks, the container having an open mouth and side walls;

and supporting the container with the open mouth facing downwardly toward the carriage such that as the stacks are formed the stacks are fed into the open mouth to engage and be surrounded by the side walls of the container to be received within the container.

According to a sixth aspect of the invention there is provided a method of forming a package of a strip comprising:

forming a plurality of stacks of the strip;

the strip having a first side edge, a second side edge, a first surface and a second surface;

in each stack repeatedly folding the strip back and forth so that the stack contains a plurality of folded overlying strip portions of the strip, with each strip portion being folded relative to one next adjacent strip portion about a first fold line transverse to the strip and relative to a second next adjacent strip portion about a first fold line transverse to the strip and spaced from the first fold line;

arranging the strip portions of each stack to form a plurality of first fold lines at one end of the stack and a plurality of second fold lines at an opposed end of the stack;

arranging the strip portions of each stack such that the first surface of each strip portion lies directly in contact with the first surface of one next adjacent strip portion and such that the second surface of each strip portion lies directly in contact with the second surface of the other next adjacent strip portion;

arranging the strip portions of each stack with the first side edges thereof lying directly on top of and aligned with the first side edges of others of the strip portions of the stack and with the second side edges thereof lying directly on top of and aligned with the second side edges of others of the strip portions of the stack;

arranging the strip portions of each stack with the strip of each stack continuous through the stack between a first end strip portion and a second end strip portion;

arranging the plurality of stacks side by side with the side edges of the strip portions of each stack adjacent the side edges of a next adjacent stack;

the plurality of stacks thus defining two fold ends of the package containing the fold ends of the stacks and two sides of the package defined by outwardly facing sides of two outermost stacks;

the plurality of stacks being arranged to define first and second strip ends of the package with the first strip end containing all of the first end strip portions of the stacks and the second strip end containing all of the second end strip portions of the stacks;

providing a container including a sleeve portion defining four walls, an end wall and an open mouth for feeding the stacks into the open mouth for insertion into the container;

providing on the first end strip portion of each stack a splice tail portion for splicing to a second end strip portion of a next adjacent stack;

before the first strip end enters the open mouth, pulling the splice tail portion to a position beyond one fold end of the stack such that, as the package is fed into the container, the splice tail portions lie along said one fold end of the stack and such that when the container is filled, the splice tail portions are exposed at the open mouth for subsequent splicing to the second end strip portions.

BRIEF DESCRIPTION OF THE DRAWINGS

Embodiments of the invention will now be described in conjunction with the accompanying drawings in which.

In the drawings like characters of reference indicate corresponding parts in the different figures.

DETAILED DESCRIPTION

The structure of the package with which the present invention is concerned is shown in more detail in the above mentioned applications including the published International application defined above. Reference is made therefore to those documents for further details of the package structure which may be necessary for full understanding of the following.

Figure 8:
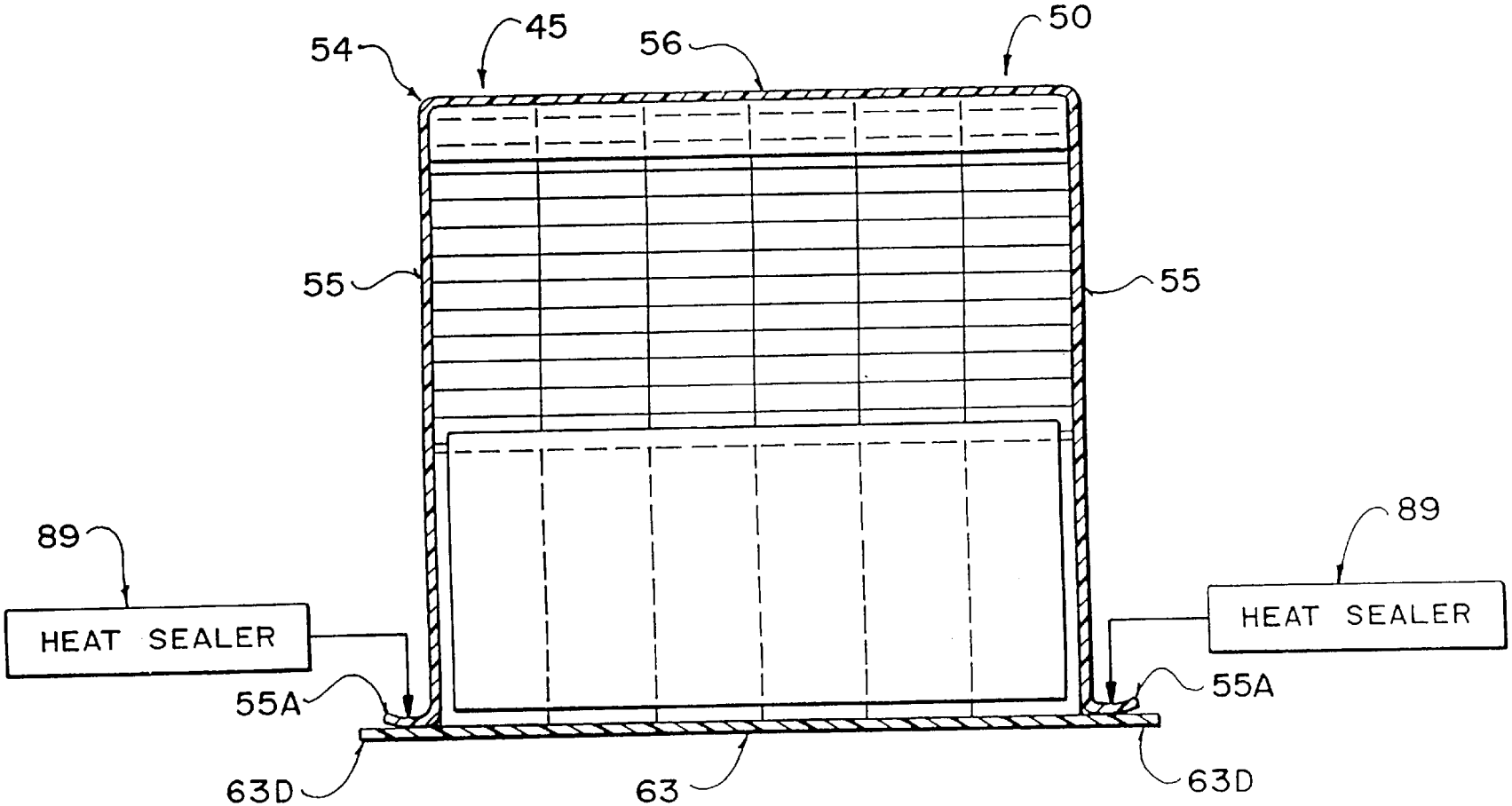
FIG. 8 is a view similar to that of FIG. 7 showing the package after compression in the compression station and after sealing of the enclosure.
Figure 9:
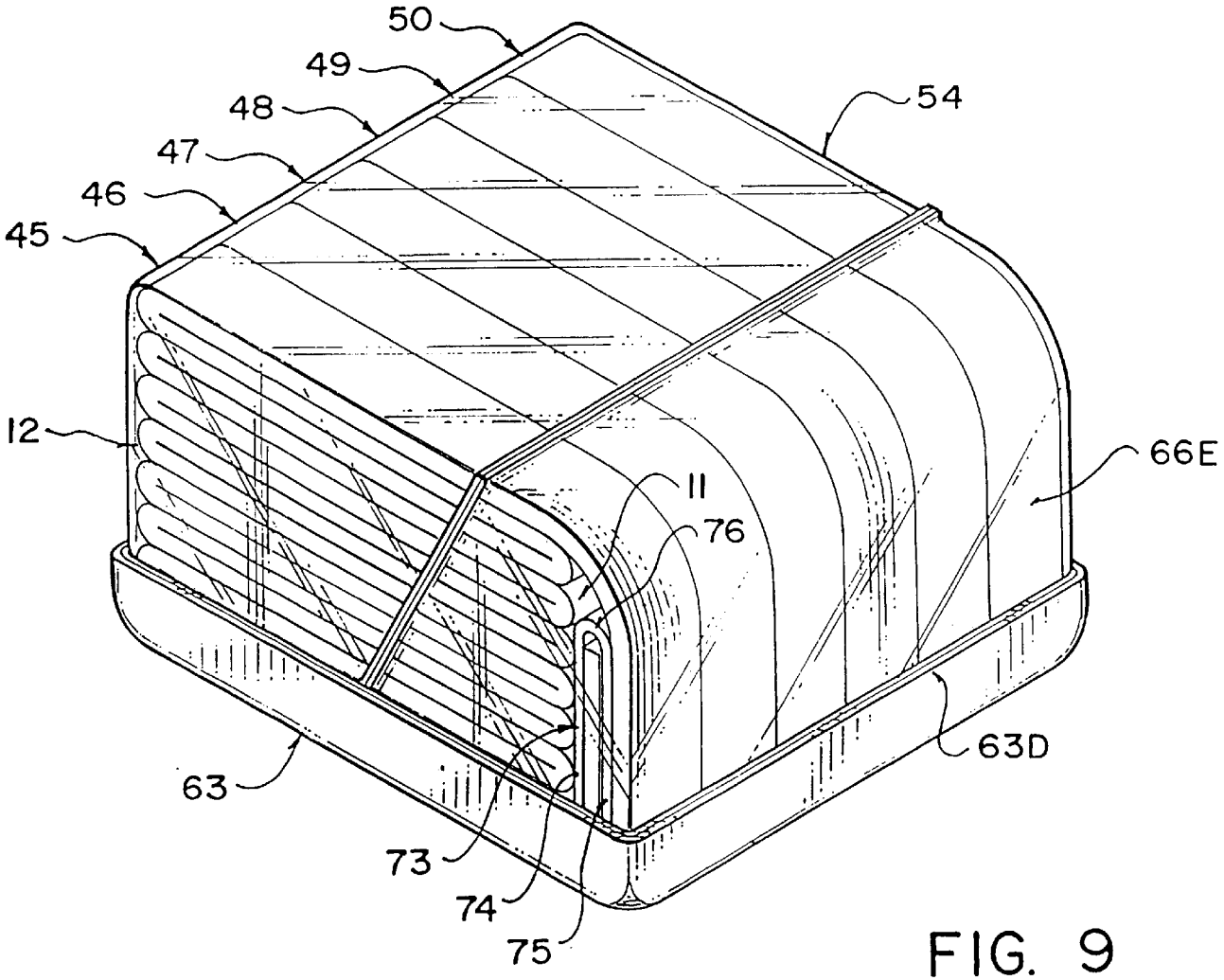
FIG. 9 is an isometric view showing the package after compression in the compression station and after sealing of the enclosure.
Figure 12:
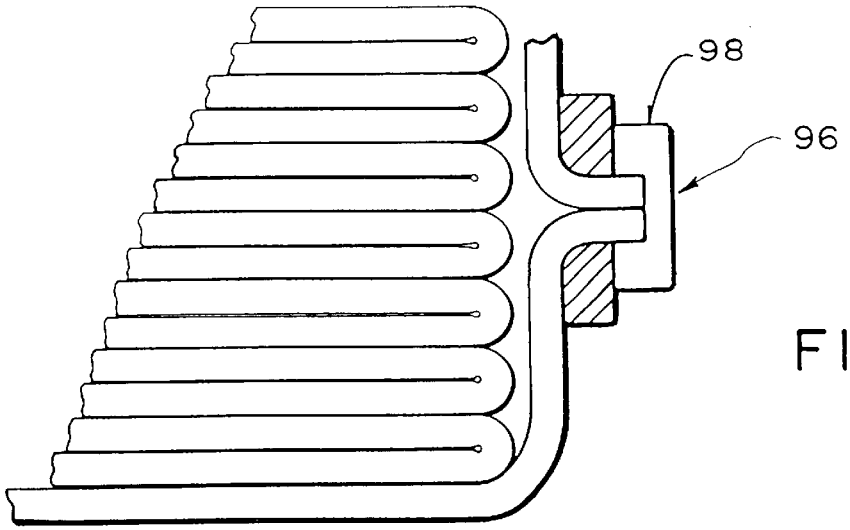
FIG. 12 is a schematic cross-sectional view showing a typical splicing jig.
Figure 10:
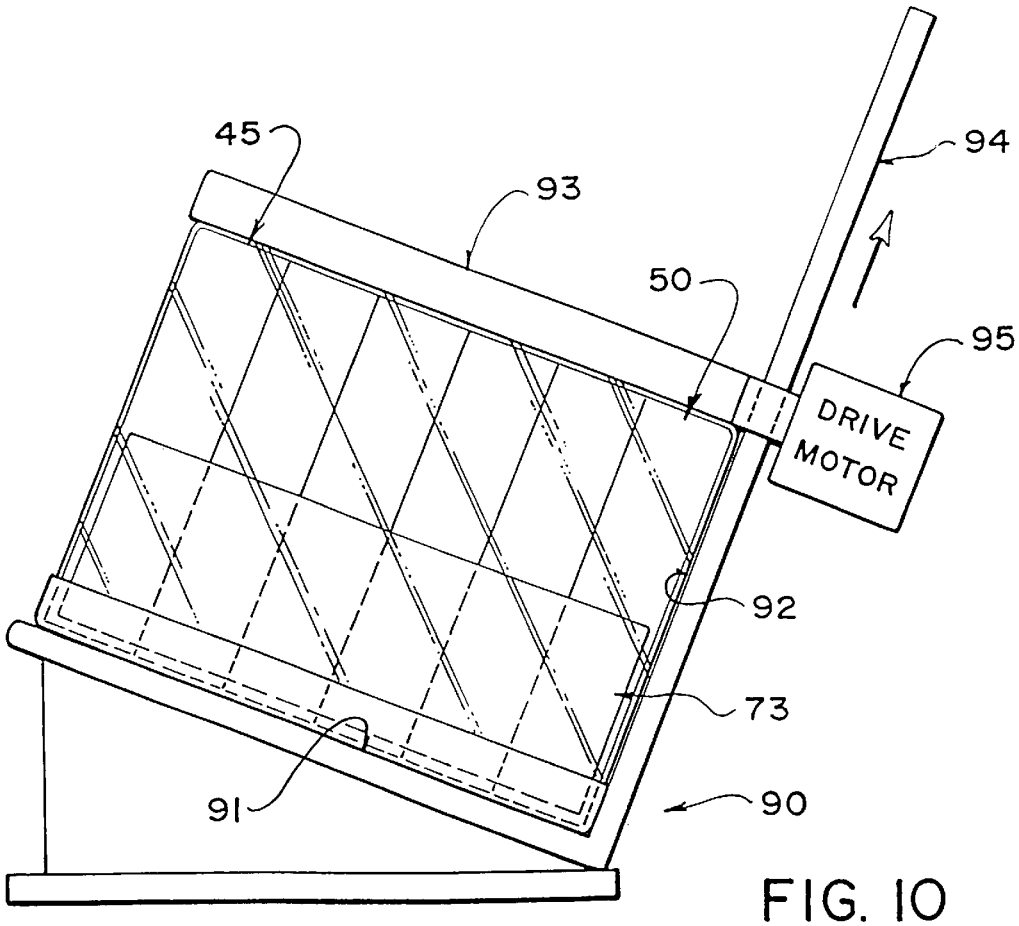
FIG. 10 is side elevational view showing the package of FIG. 9 in an unfolding stand prior to opening of the package for pay-off of the strip.
Figure 11:
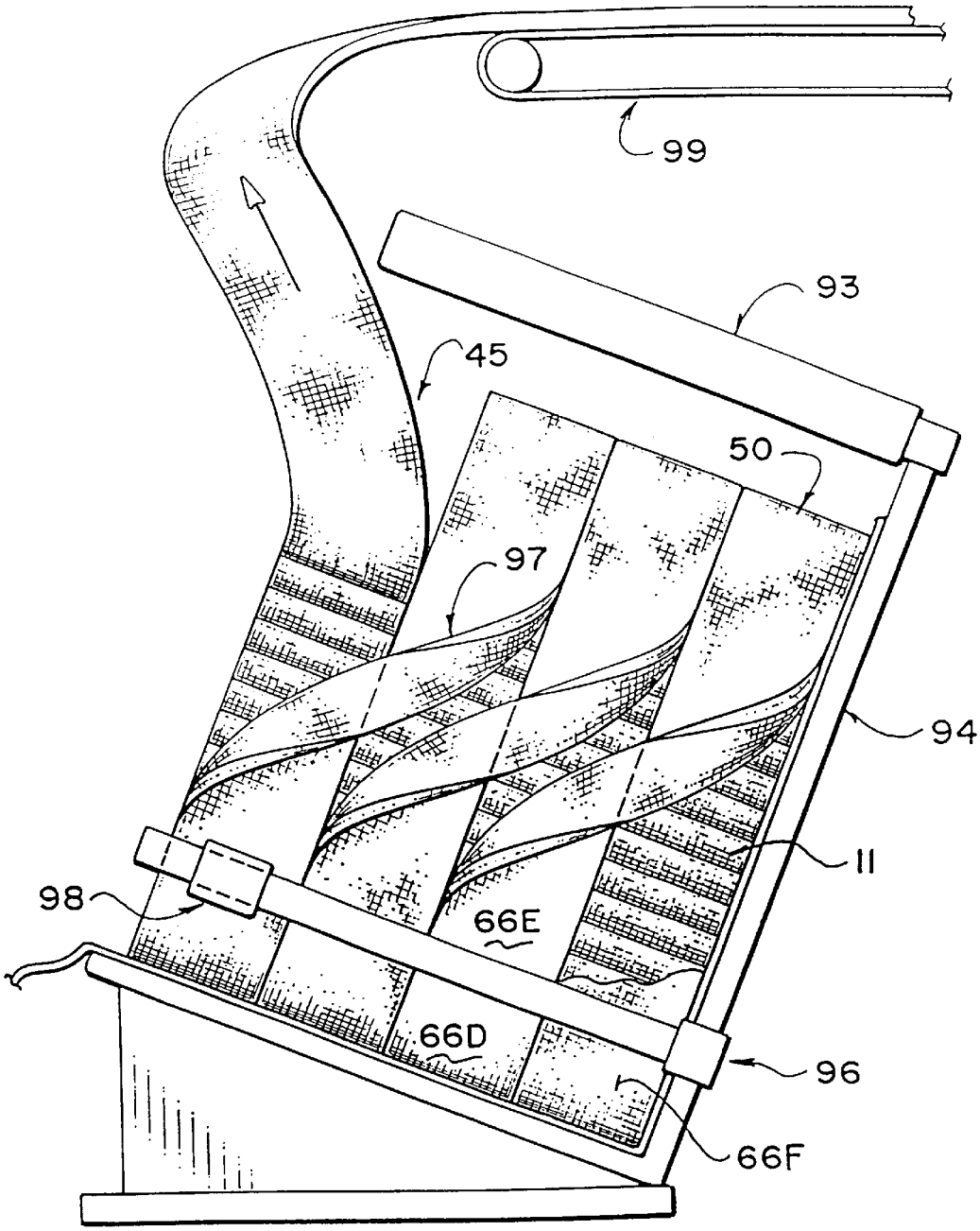
FIG. 11 is side elevational view showing the package of FIG. 9 in the unfolding stand during pay-off of the strip.

The present Invention is concerned with the machine for forming the package which is shown in FIGS. 1 through 9 together with the unfolding stand of FIGS. 10, 11 and 12 which allows the package formed in the machine to be property controlled and handled during the unfolding process.

Figure 1:
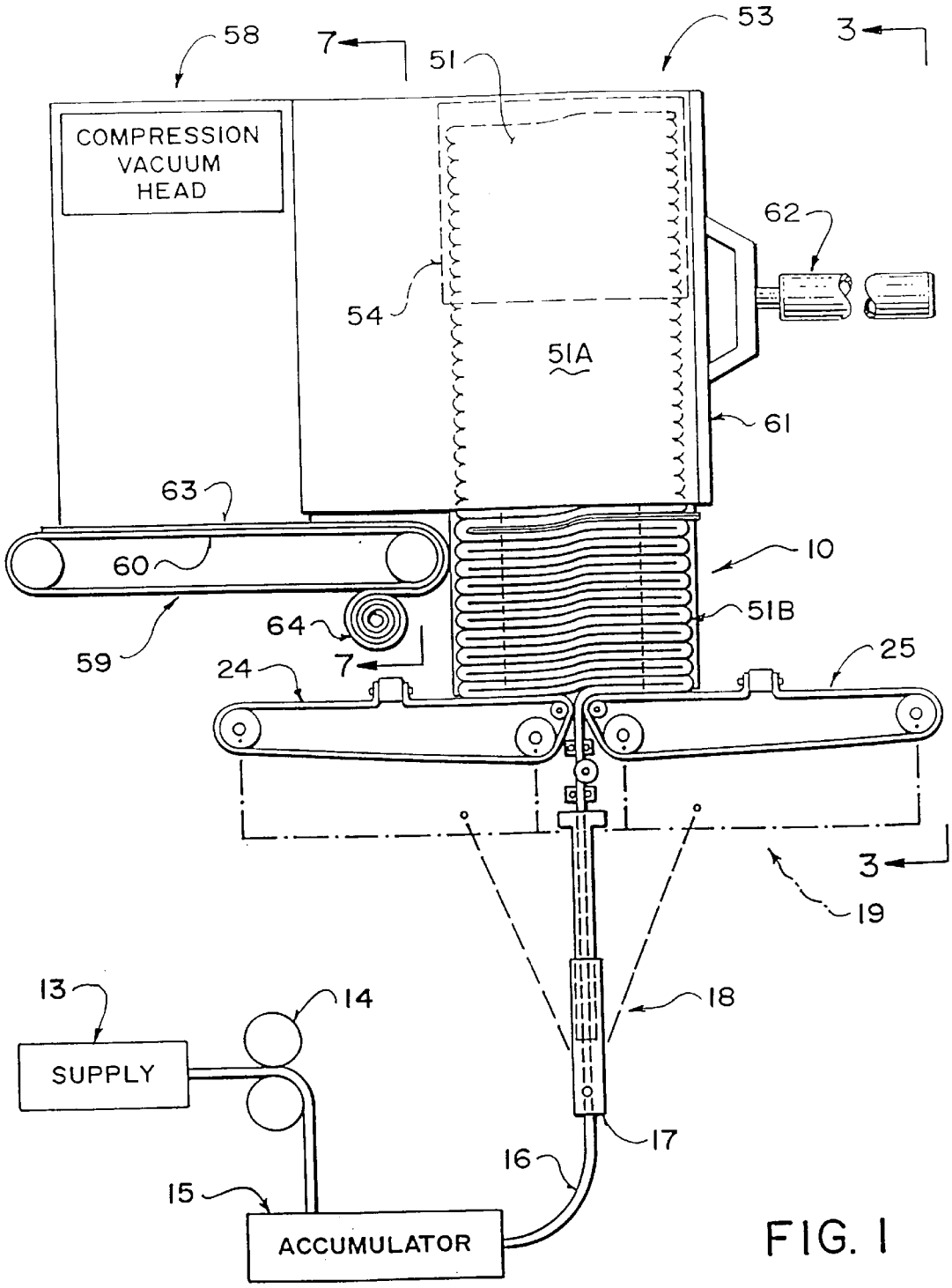
FIG. 1 is a side elevational view of a process of forming a package of a strip according to the present invention.
Figure 2:
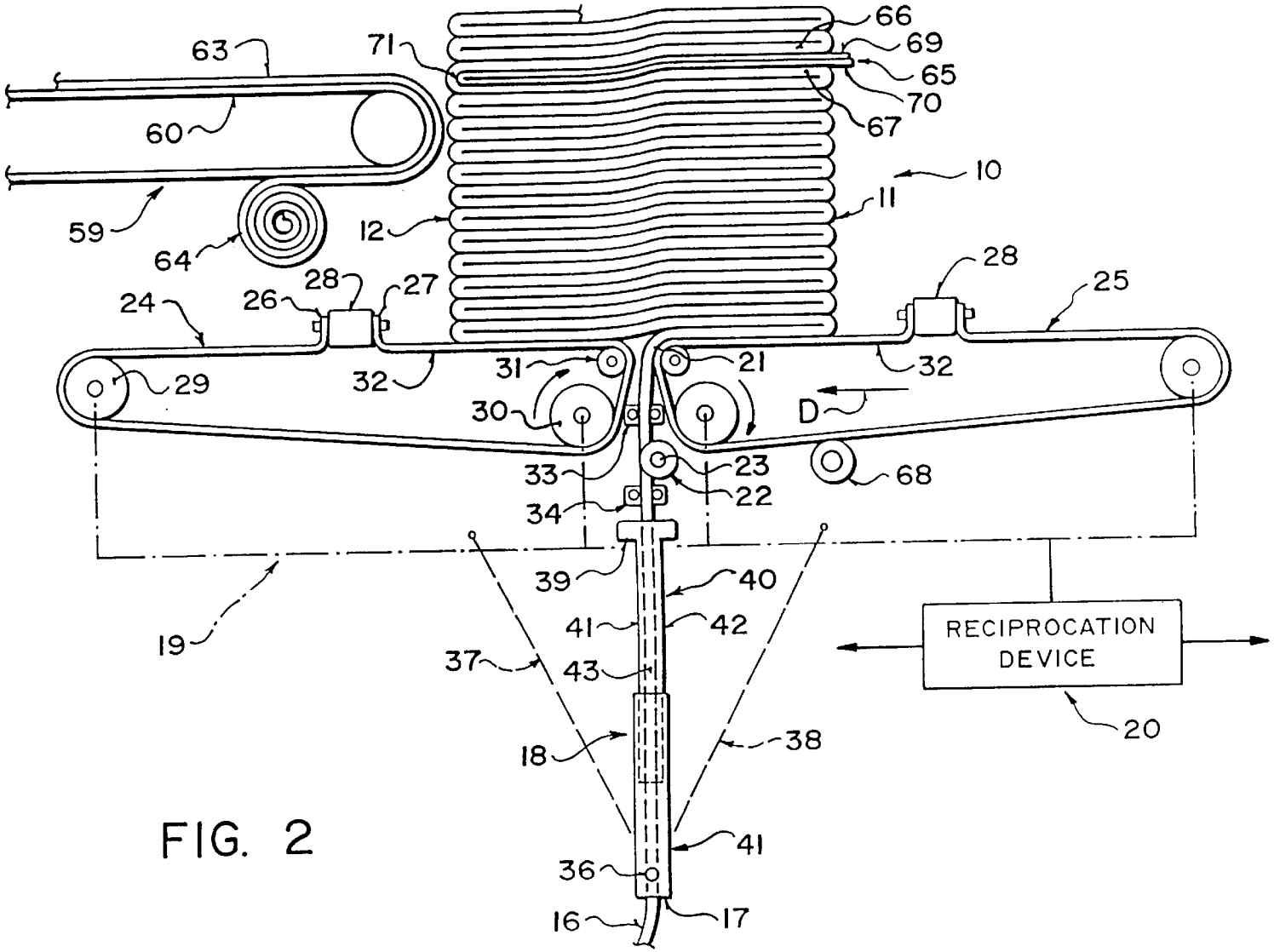
FIG. 2 is a similar view to that of FIG. 1 showing a portion of the process on an enlarged scale.

Turning now to FIG. 1 there is shown a package structure 10 formed by a plurality of side by side stacks of the strip material. Each stack is formed as best shown in FIG. 2 by zig zag folding of the strip back and forth between fold lines 11 and 12 to form overlying portions of the strip. The strip is folded so that each portion lies directly on top of the previous portion with the side edges thereof aligned. The length of the portions is constant so that the stack defines ends containing fold lines which are vertical and parallel.

The material defined in the strips is forwarded from a supply 13. This supply can be direct from a manufacturing line without any intervening winding or rolling of a web or can be in other situations a roll of web of the material.

The supply is forwarded through a driven forwarding system 14 into an accumulator 16 or dancer arrangement which acts to temporarily accumulate the material since the supply is generally forwarded at constant speed while the folding action varies in speed in view of the reciprocating action described hereinafter.

From the accumulator the material in a width approximately equal to the width of the package is fed as a sheet 16 into a mouth 17 at the bottom of a rectangular duct 18 through which the sheet or web of the material passes.

The material carried through the duct is transported to a carriage generally indicated at 19 which is reciprocated back and forth by a drive device schematically indicated at 20. The carriage 19 in effect defines a slot 21 which is carded by the carriage back and forth underneath the stacks 10 so that the strip material is fed through the slot 21 and is carried by the slot back and forth between the fold lines 11 and 12 to define the folded strip portions.

In one alternative arrangement, the web of material is slit into individual strips in the supply 13 and thus is supplied through the accumulator and into the chute 18 in the farm of side by side individual strips. In this arrangement, it may be desirable to provide two separate supplies in which the strips are arranged alternately in a first supply and a second supply then brought together in the side by side arrangement prior to entering the duct 18 so the strips are property guided side by side without the possibility of any overlap.

In a second alternative and preferred arrangement illustrated in FIG. 2, the material from the supply 13 is instead in web width without being slit into individual strips. In this arrangement the web is slit by a plurality of slitting blades 22 into the individual strips side by side. The blades 22 are of the disc type mounted on a rotary shaft 23 driving the blades in a rotary action so as to provide an accurate slitting effect. The blades are arranged at spaced positions along the length of the shaft with a shaft extending across the width of the web, the spacing being selected to provide the required width of the individual strips. The blades will also act to trim each edge of the material in conventional manner so that the finished width of the package is less than the feed width of the material.

The slot 21 is defined between a pair of belts 24 and 25. Each belt has ends 26, 27 attached to a fixed mounting block 28 which remains stationary during the folding action.

Each belt is wrapped around a first end support roller 29 and a second end support roller 30. At the roller 30 is provided a second smaller support roller 31 so that the rollers 30 and 31 cooperate to support one end of the belt. The rollers 30 and 31 at one end and the roller 29 at the other end of the belt thus cooperate in holding the belt in tension stretched on either side of the block 28.

The rollers 29, 30 and 31 are carried on the carriage 19 in fixed position on the carriage so that they reciprocate with the carriage back and forth.

The roller 31 is relatively small in comparison with the roller 30 and is positioned above the roller 30. Thus the rollers 31 of the two belts 24 and 25 are arranged closer together than the rollers 30 so that the two belts converge together from a wider mouth wrapped around the rollers 30 to a narrower position at the slot 21 defined between the rollers 31.

The carriage can include further support plates supporting the upper run 32 of the belts between the block 28 and the slot roller 31. The rollers 30 and 31 are supported on the carriage by mechanical supports which allow the rollers to support the belts and thus to support the package as it is formed on top of the carriage.

Thus as the carriage reciprocates back and forth, the slot between the slot rollers 31 is moved firstly toward the left as indicated at arrow D so that the portion 32 of the belt 24 decreases in length as the roller 31 moves toward the block 28. At the same time the portion 32 of the belt 25 between the roller 31 and the block 28 increases in length. However the belt portions in effect remain stationary and act to support the underside of the package 10 which also remains stationary relative to the movement of the belt and the blocks 28.

The slot is thus moved to the fold lines 12 where the movement of the carriage is reversed to a direction opposite to the arrow D thus carrying the strip back from the fold lines 12 toward the fold lines 11.

The rollers 31 rotate in the same direction at all times. As the carriage 19 is reciprocated, the direction of the rollers reverses at each end of the reciprocating movement.

Thus while the carriage is moving in a direction D, the rollers 31 rotate in a clockwise direction and while the carriage moves in the direction opposite to arrow D, the rollers rotate in a counter clockwise direction. Thus at all times, one of the rollers acts to feed the strip through the slot while the other is rotating in a direction opposite to the feed direction. The slot is therefore slightly wider than the thickness of the strip material since the strip material cannot be nipped between the rollers. The rollers thus alternately act to feed the material and to carry the material onto the top of the belt run as shown in FIG. 2, where the strip material is carried over the roller 31 of the belt 25 and deposited onto the upper run 32 of the belt 25.

The provision of the smaller rollers 31 acts to allow the belts to come together sufficiently to enclose the strip material without nipping the strip material.

A one way brake arrangement 33 is provided in the neck area between the rollers 30 and immediately below the slot 21 so as to allow the strip material to feed forwardly while preventing any reverse movement of the strip material. This one way brake arrangement ensures that the strip is fed positively through the slot and is prevented from slipping back through the slot at the fold lines where there is a tendency for reverse movement to occur. In between the fold lines, it will be appreciated that the strip material is carried over that roller which is rotating in the required feed direction and is deposited on to the top of the belt in a positive feeding action.

In the arrangement previously described where slitting occurs prior to the chute 18, only a single brake 33 is required immediately upstream of the slot 21.

In the alternative arrangement as shown including the slitting discs 22, there is preferably provided a second one way brake arrangement 34 located upstream of the slitting discs so that the slitting discs are carried between the brakes 33 and 34 thus maintaining tension across the strip as it is being slit.

The chute 18 has a lower end mounted on a horizontal pivot mounting 36 defining a horizontal axis extending across the bottom of the chute. Thus the mouth 17 is maintained at a fixed position relative to the accumulator as the carriage moves back and forth while the chute pivots between extreme positions indicated at dotted lines 37 and 38. The chute 18 has an upper end 39 attached the carriage 19 so that the upper end is carried back and forth between extreme positions 37 and 38. In order to accommodate the change of length necessary to maintain the lower end 17 at the fixed position and to move the upper end back and forth, the chute 18 is formed in an upper section 40 and a lower section 41 with one being slidable inside the other such that the length of the chute between the lower mouth 17 and the upper end 39 varies in length.

The chute is defined by two side walls 41 and 42 and by two end walls 43 and 44 thus fully enclosing the sheet material. Thus the chute 18 in its movement takes up and accommodates any forces from air moved by the chute to rather than allowing the air to apply forces to the sheet material itself. This reduces the "sail" effect on the sheet material as it is transferred from the accumulator to the carriage.

Figure 3:
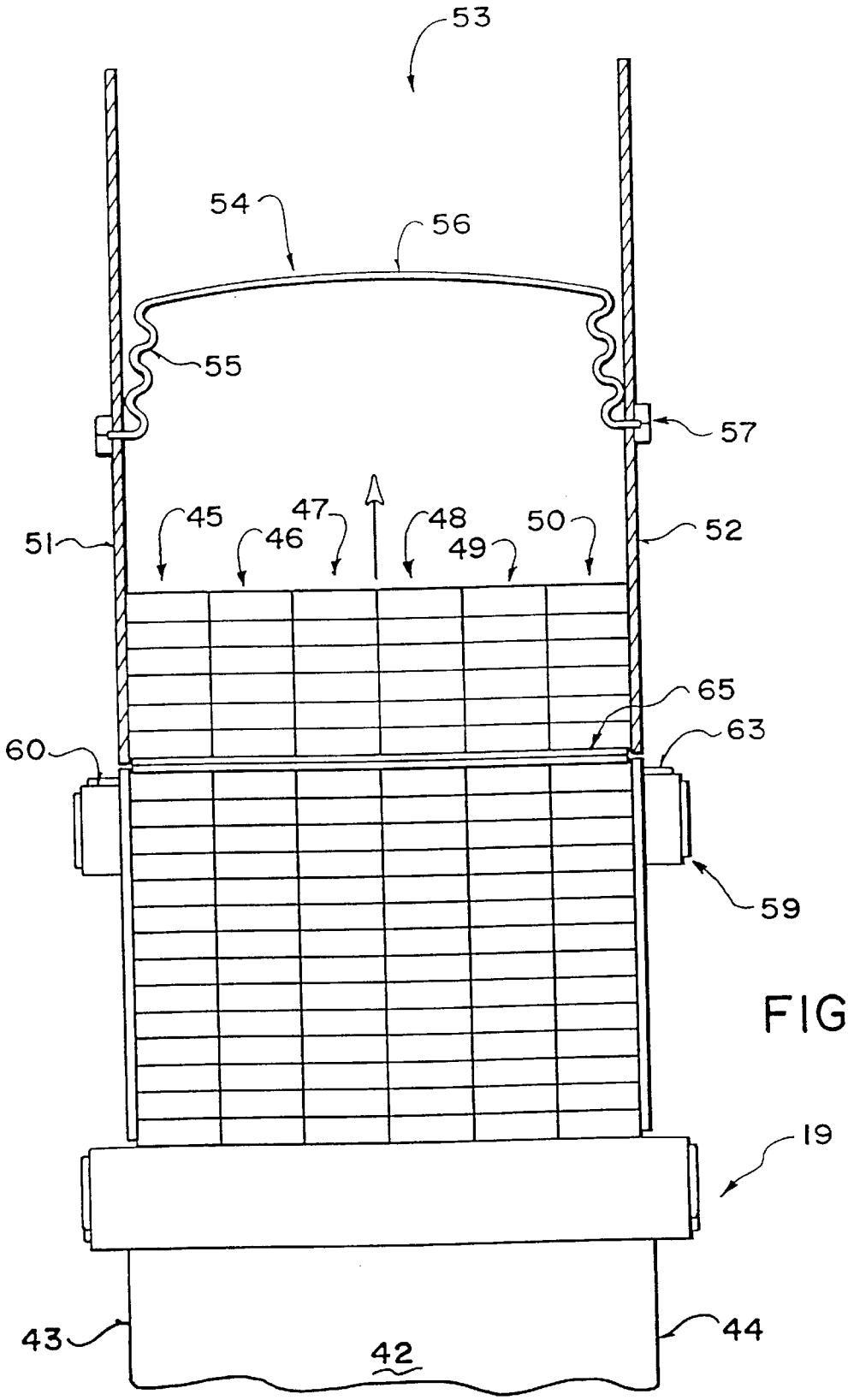
FIG. 3 is side elevational view along the lines 3—3 of FIG. 1.
Figure 4:
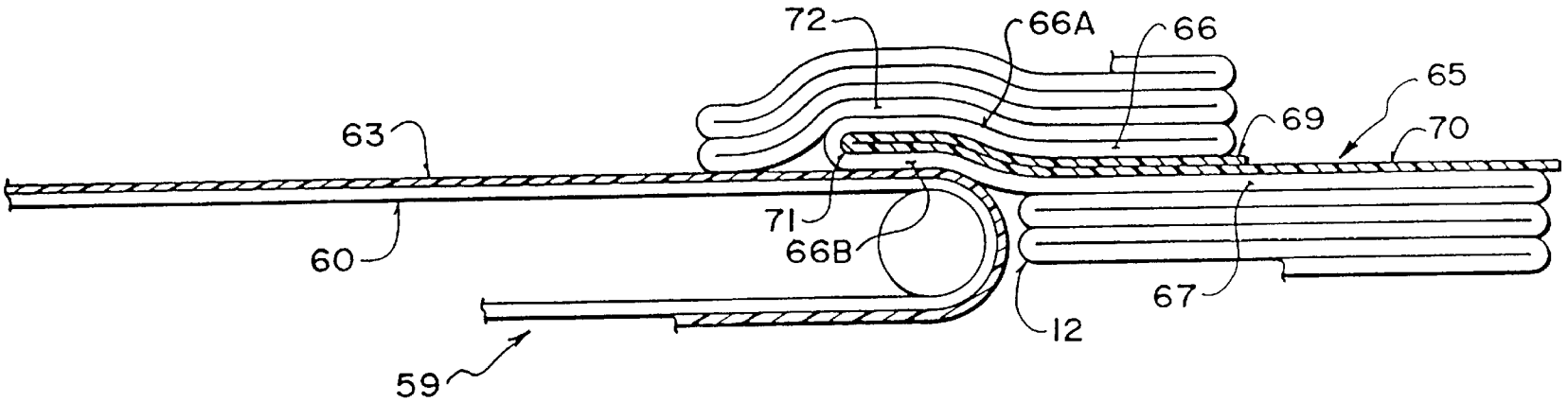
FIG. 4 is a cross-sectional view through the transfer area of FIG. 1 showing the movement of the stacks from the folding position to the compression station.

As shown in FIG. 3, the package contains six individual side by side stacks illustrated although it will be appreciated that the number of stacks can vary depending upon the width of the strips and the required width of the finished packaged structure. Thus the six stacks are generally indicated at 45, 46, 47, 48, 49 and 50. The stacks are parallel and side by side and each supports the next. However in order to maintain the stacks in vertical orientation, it is necessary to provide side walls 51 and 52 which engage the side edges of the end most stacks 45 and 50. The side walls can be complete covering the full length of the strip portions as shown in the upper part of the side walls as indicated at 51A or can be relatively short length side walls engaging only the ends of the stacks as indicated at 51B. However in all cases along substantially the full height of the structure, it is necessary to support and engage the outside edges of the stacks to maintain the stacks in proper vertical orientation.

The stacks are therefore built up by reciprocation of the carriage and 19 supported on the carriage up to a position at the top of the side walls 51 thus providing a stack of a required height. The height can of course be varied depending upon requirements for the finished height of the package and depending upon the amount of compressibility of the sheet material.

Thus in FIG. 3, at a stack building station indicated at 53, the stacks are shown partly built from the carriage 19 up to an intermediate height. In order to contain the formed stacks, there is provided a containment enclosure 54 in the form of a flexible bag having side walls 55 and a top 56. The top of the bag can remain open or can be closed or partly dosed leaving an open mouth at the bottom of the side wall 55 into which the stacks are pushed. The open mouth is supported by a suitable clamping assembly schematically indicated at 67 mounted on the side walls 51 and 52. Thus during the formation of the stacks, an operator inserts the bag into the building position 53 with a rectangular open mouth and a rectangular side wall defined and shaped to match the outside cross sectional shape of the package. This allows the building of the package to cause the stacks to slide upwardly along the inside surface of the side wall 51 and 52 and to engage the bag which is pressed against the side wall by the forming stacks thus pushing the bag so that its upper end 56 moves upwardly with the stacks while its open mouth is held at a fixed position by the clamping assembly 57.

The length of the side walls of the bag is selected so that it is equal to the finished compressed height of the package as discussed hereinafter. Thus the clamping assembly 57 is located at a position spaced downwardly from the top edge of the side walls by a distance equal to the length of the bag and thus the clamping assembly is located above the bottom of the stack.

When the stacks are built up to the required height thus filling the bag and expanding the bag to its full length, the mouth of the bag is released from the clamping assembly 57 allowing the built up stacks to be transferred from the building station 53 to a compression station generally indicated at 58.

The compression station 58 includes a support conveyor 59 having an upper run 60 on which the stacks are supported.

The upper run 60 of the conveyor 59 is located at a height spaced upwardly from the carriage 19. Thus, as transfer of the built up stacks from the position 53 onto the conveyor 59 occurs, this leaves a lower portion of the stacks below the upper run 60 which remain on the conveyor 19 thus providing a base for a next package structure to be formed with that base providing a weight onto the carriage sufficient to maintain the effective folding action as the carriage continues to reciprocate.

The movement of the upper portion of the stack above the conveyor 59 is therefore effected by a pusher plate 61 having a height equal to the height of the portion of the stack to be pushed thus acting to apply force to that portion to move it from the position 53 onto the conveyor 59. The pusher plate is actuated by a cylinder 62 or similar actuator. The pushing action of course also carries the bag surrounding the upper part of the stacks from the station 53 and the side walls 51, 52 into the compression station.

Figure 7:
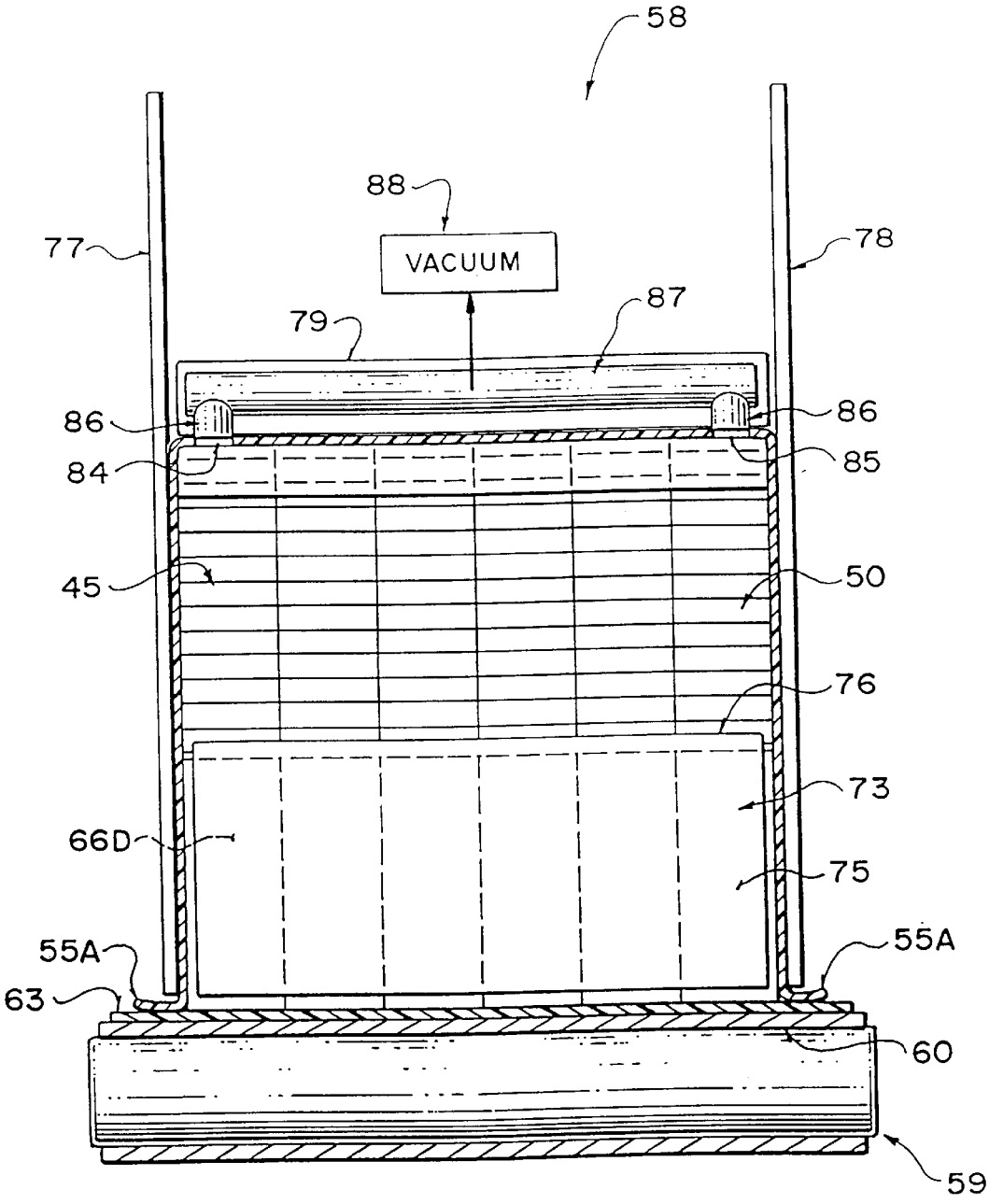
FIG. 7 is a view along the lines 7—7 of FIG. 1 showing the package after compression in the compression station.

The enclosure for containing the stacks after compression includes the bag 54 and also a base sheet 63 which is supplied on top of the upper run 60 of the conveyor 59. A supply roll 64 for the base sheet is mounted adjacent the conveyor and feeds the sheets so that it runs across the upper run 60 as a continuous strip onto which the stacks are pushed. The width of the sheet 63 as shown in FIGS. 3 and 7 is greater than the width of the package structure defined by the outer surfaces of the stacks 45 and 50.

In order to ensure effective separation of the upper part of the stacks above the conveyor 59, an insert member 65 is provided which engages between a lower most strip 66 of the upper part of the structure and an uppermost strip 67 of the lower part of the structure to remain in place on the carriage 19.

The separator member 65 is provided as a flexible plastics sheet which is fed into place during the formation of the stacks. Thus a feeding roller 68 is provided cooperating with the belt 25 which carries the plastic sheet and at a, required position during the build of the stacks releases the flexible plastics sheet so that it is fed on the right hand side of the strips to underlie a series of the strips as the carriage moves from right to left in the direction of the arrow D and then is covered up by movement of the carriage in the opposite direction to take up the position, after build of further portions of the stack, as shown in FIG. 2. It will of course be appreciated that the position of insertion of the separator member 65 is selected during the build of the stacks so that the separator member reaches the height of the conveyor 59 when the top of the stacks reaches the required height.

Figure 5:
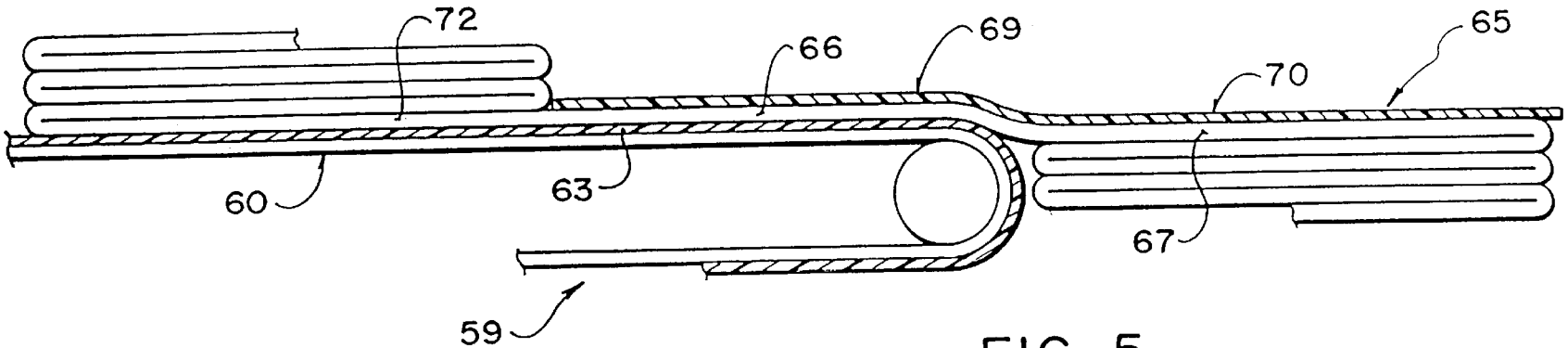
FIG. 5 is a cross-sectional view similar to that of FIG. 4 showing is the stacks after movement to the compression station.

Preferably the separator member 65 comprises a folded sheet of plastics material thus defining two layers of the sheet 69 and 70 connected by a fold 71. Thus movement of the stacks can be seen by following the steps shown from FIG. 2 through FIG. 4 to FIG. 5. In this moving action, the strip 67 underlying the member 65 remains in fixed position. The strip 66 unrolls across the gap between the fold lines 12 of the stack and the conveyor 59. The strip 66 as it unrolls carries with it the upper sheet 69 of the member 65 so that that sheet unrolls also and slides across the underlying sheet 70. The use of plastics materials provides a low level of friction allowing a ready sliding action. As the unrolling and moving effect occurs a next adjacent strip 72 overlying the strip 66 becomes the lower most strip and drops on the shot 63 on top of the upper run 60. The conveyor can be moved forwardly at this time to carry the lowermost strip 72 forwardly away from the position 63. Alternatively or additionally the sheet 63 can allow a sliding action. Thus the strip 66 is unrolled so that an upper portion 66A of that sheet gradually reduces in length and a lower portion 66B increases in length until a position shown in FIG. 5 is taken up in which the strip 66 is wholly unrolled and provides an interconnection from the lowermost strip 72 to the uppermost strip 67. In this position the sheets 69 and 70 of the member 65 are wholly unrolled and the sheets simply lie on top of the upper most strip 87 and the unrolled strip 66 and thus the member 65 can be removed as indicated by the arrow R in FIG. 6 for replacement at the feed device 68 of FIG. 2.

Figure 6:
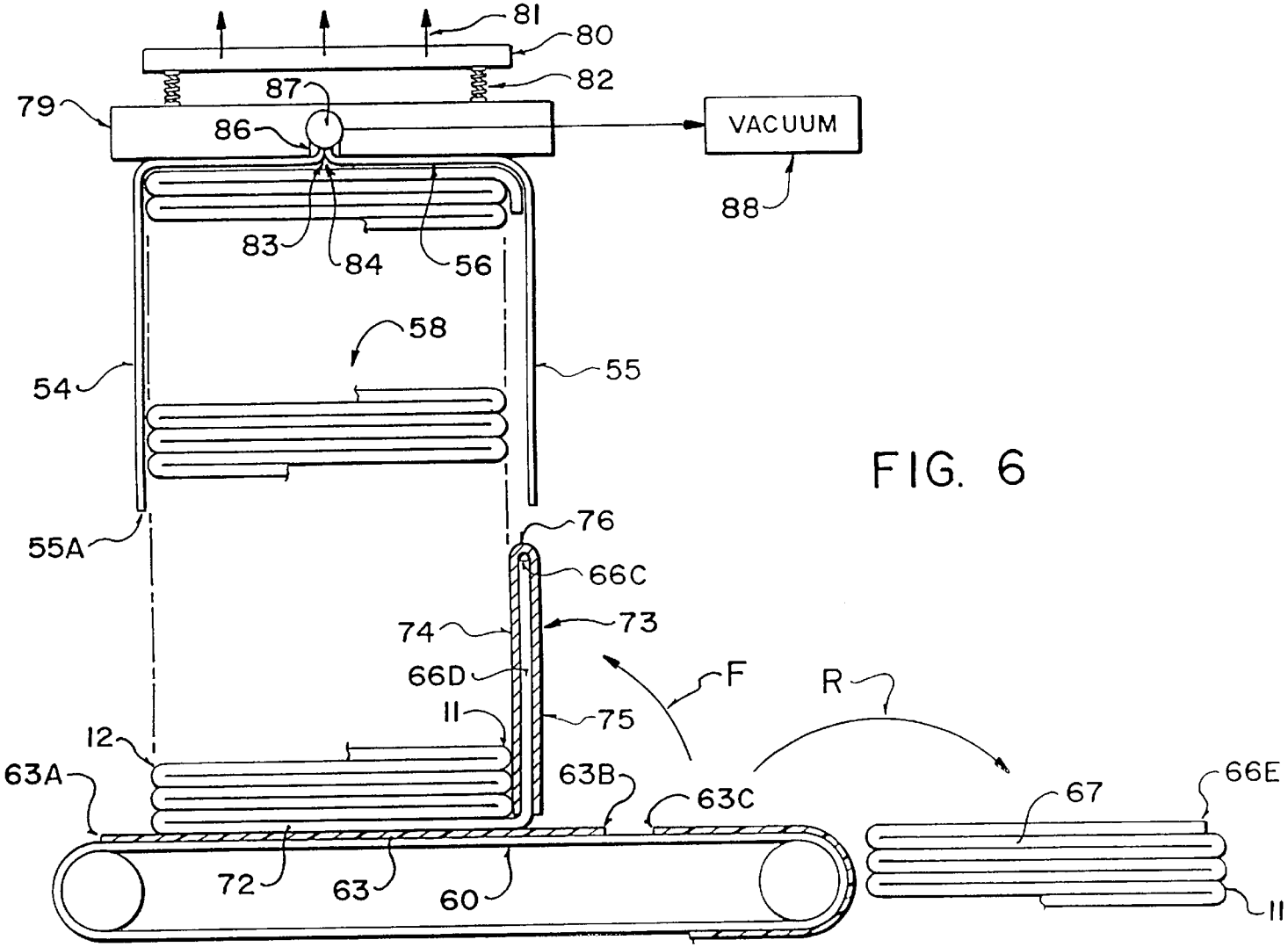
FIG. 6 is a cross-sectional view similar to that of FIG. 5 showing the compression station.

As shown in FIG. 6, after the transfer to the compression position 58 has occurred, the strip portion 66 is cut to define a first end 66C at the end of a portion 66D of that strip which is interconnected to the lowermost strip 72. An opposed end 66E is folded back onto the top strip portion 67 which remained in place so that the end 66E is arranged at or beyond the fold lines 11. A portion of the strip may be removed or unfolded from the top of the stacks in order to achieve this positioning of the ends 66C and 66E. The length of the strip portion 66D which is exposed beyond the end of the stack connected to the strip 72 is unlikely to be the full length of the strip 66 since it is undesirable to provide a tail portion of this long length. In general the length portion is preferred to be just sufficient for easy manipulation in the unfolding operation as discussed hereinafter.

Thus in a typical example, the compressed height of the package is likely to be of the order of three feet which is less than the length of the strip portions which are generally of the order of four feet in such an example, the envelope can be arranged to be equal in height to the height of the package so that the envelope acts as a header plate for the end of the package.

The end 66E is shown in FIG. 6 as being located directly at the fold lines 11 so that it is accessible at the top of the package at the end of the fold lines 11. However the end can be arranged so that it hangs from the top of the package along the end of the package downwardly toward the bottom. This makes the end 66E even more accessible for later splicing as described hereinafter.

The portion 66D is enclosed within an envelope 73 which is formed by two sheets of a suitable protective material such as cardboard with an inner sheet 74 and an outer sheet 75 folded at an upper fold line 76 so that the row of strips each from a respective one of the stacks defined by the portion 66D are arranged in a row as best shown in FIG. 7. The envelope is folded, as indicated by the arrow F, upwardly to lie flat along the fold lines 11 of the stacks. In such an example, the envelope can be arranged to be equal in height to the height of the package so that the envelope act as a header plate for the end of the package.

The sheet 63 as shown in FIG. 6 is cut so that it has edges 63A and 63B which extend beyond the fold lines 11 and 12. Thus each package has its own base sheet separated from the base sheet supply and a leading edge 63C of the next base sheet is provided for the next package to be formed and transferred as described before. At the compression station 58 as shown best in FIGS. 6 and 7 there is provided a pair of rigid side walls 77 and 78 which support the sides of the outermost stacks 45 and 50. The side walls 77 and 78 are separate from the side walls of the folding station so that they are movable to release the package when required, so that they have sufficient strength to accommodate the compression forces during the compression action and such that the position and structure of the walls allows the operator to access the envelope 73 and the heat sealing action as described hereinafter.

As shown in FIG. 6, the upper part of the package is surrounded by the bag 54 with the depending side walls 55 terminating at a lowermost edge 55A. This position can be located above the top of the envelope 73 so that the envelope can be folded up into position underneath the bottom of the bag. Alternatively when the cross-section of bag used is larger than the package, the bag is sufficiently loose to allow a higher envelope to be used so that is height is equal to the height of the compressed package. Thus it is necessary toed this under the bottom edge of the bag. The tails at the top of the package defined by the end 66E, as they preferably hang down, thus hang down over the front of the envelope so that the envelope thus acts as a header plate protecting the top tails from crinkling under compression.

A compression weight 79 is provided having sufficient mass to apply a vertical load on the package structure to compress the stacks down to a required compression level. The amount of compression will vary depending upon the material to be packaged. The compression acts therefore to reduce the height of the package from a rest height to a compressed height in general the material to be packaged is often of a fibrous nature so that compression is effected by expelling air from the individual strips thus reducing the thickness of each strip and thus the total height of the stacks. The amount of force applied is controlled by supporting the weight 79 on a carrier 80 which is supported on a suitable suspension system 81 (not shown). A plurality of load cells 82 interconnect the carrier 80 and the weight 79 so that the actual force applied to the package can be calculated from the load cells and the suspension system 81 operated to maintain a required compressive force.

As the compression action is effected, the lower end of the bag 54 is, wrapped around the envelope 73 and around a lower part of the stacks and pulled down until the bottom edge 55A reaches the sheet 63.

As previously described, the upper end 56 of the bag is wholly or partly closed by a heat sealed seam 83. This can be effected prior to application of the bag as shown in FIG. 3 or can be effected as part of the compression step at the station 58.

The heat seal 83 leaves open two openings 84 and 85 each adjacent a respective side of the package and these openings are engaged with duct sections an 86 which connect to a main vacuum duct 87 connected to a vacuum source 88. As the compression action occurs, therefore, air is withdrawn from the packager structure through the upper part of the bag to take up that air which is expelled from the package structure due to the compression. Of course some air also escapes underneath the bottom of the bag but this amount of escaping air will reduce as the bottom edge 55A is pulled down toward the base sheet 63A When the bottom edge 55A reaches the sheet 63, as shown in FIG. 8, the bottom edge is turned slightly outwardly to overlap with and contact those side edges of the sheet 63 which are exposed beyond the bottom edge of the bag. Thus the bottom edge 55A overlies the edges 63D and a heat sealer 89 is used to seal the out turned edge portions 555A to the base sheet around the periphery of the bag. The upper run of the conveyor acts as an anvil for the sealing action. The heat sealing action can be effected by various different techniques including heated air, heat sealing blades which are brought up mechanically to apply heat or a rotary device which moves around the bottom of the package to provide a peripheral seal. With the package thus sealed, further vacuum is applied form the vacuum source 88 through the openings 84 and 85 until the package is evacuated to a required negative pressure thus drawing the slightly oversize bag down onto the package. At this position the openings 84 and 85 are closed by heat sealing in a conventional manner so that the package is fully sealed. It will be noted therefore that the height of the bag is equal to the height of the compressed package and that there is no excess bag portion or excess material required thus reducing the quantity of packaging material. Furthermore in the event that a leak should occur through one of the seams, the package cannot expand back to or toward its rest height since it is maintained in the compressed condition by the taut bag. In the event of a leak, some bowing of the bag structure may occur but the package cannot dramatically expand as can occur in the situation where the bag has a length greater than the compressed length.

The completed compressed and sealed package is therefore shown in FIG. 9 where the ends 66E are shown at the same end of the package as the envelope 73 and are shown in the optional condition depending down the end of the package. The envelope 73 is free from compression or crinkling in a vertical direction even though the package material defined by the bag pulls the envelope tight against the end of the package structure and against the fold lines 11.

The bag is preferably formed of a laminate of an internal nylon material which provides high impermeability and high strength together with an outer layer of polyethylene which provides the necessary heat sealing effect. The bag can be formed of a material having a total thickness of the order of 0.003 mil. The base sheet is formed from a similar material defining a nylon outer layer and a polyethylene inner or upper layer which is heat sealed to the outer layer on the bag. The base sheet can be formed of a thicker material of a thickness of the order of 0.003 to 0.010 mil to provide additional strength to accommodate engagement with forks of the fork lift truck or other lifting device.

In this condition the package can therefore be stored and transported while it is maintained in a dean environmentally sound condition.

Turning now to the unfolding arrangement shown in FIGS. 10 and 11, the package of FIG. 9 is thus transported to an unfold stand generally indicated at 90 of the type shown and described in the above prior applications and particularly the International application defined above. Thus the unfold stand provides an inclined bottom surface 91 which reeves the bottom surfaces of the stacks 45 through 50 and an inclined side wall 92 which receives the side surface of the stack 50 and provides some support for that surface. Thus each of the stacks is inclined so that it leans onto the next adjacent stack with the stack 45 outermost and presented uppermost for initial unfolding. In this arrangement there is provided a header plate 93 which engages the top surfaces of all of the stacks and provides pressure thereto. The header plate is mounted on a guide 94 and can be driven along the guide 94 by a drive motor 95 or a cylinder in a sliding action so that it can be raised from the pressure position shown in FIG. 10 to a released position raised upwardly above the upper surface of the package shown in FIG. 11. The header plate can be located at the pressure position and free sliding when unlocked so that it is moved by pressure from the package and lifted away from the package by the operator.

In an initial step in the unfolding action, therefore, me package in its compressed and wrapped condition is applied onto the unfold stand and the header plate 93 moved into position pressing against the upper surface of the sacks. The header plate is shaped to allow access to the top of the package around its full periphery to allow it to be cut open.

With the package thus constrained, a slit is formed in the bag around the top of the bag so that the top of the bag is in effect fully separated from a lower part of the bag thus releasing the vacuum while the package is maintained in compressed condition by the header plate. With the bag thus fully opened, the drive motor 95 is operated or the header plate unlocked to gradually release the pressure on the stack so that the stacks expand from the compressed condition back toward the initial rest condition. As shown in FIG. 11, the header plate is moved to a position spaced from the stacks allowing them to be fully exposed and the header plate can indeed be rotated fully from the area of the upper part of the stacks to allow the upper part to be fully exposed for unfolding.

Thus with the package structure released from compression as shown in FIG. 11, the remaining parts of the bag are cut away thus releasing the envelope 73 which is then removed releasing the tails 66D. A splicing jig 96 mounted on the guide 94 is moved into position along the fold lines 11 of the package structure. The splicing jig 98 includes a support bar over which the tails are laid and a clamping element movable into a clamping position for holding the tails 66D of the stacks (with the exception of the tail indicated at 66E of the stack 50 which is exposed for connection to a next adjacent package as the trailing end of this package structure).

The free ends 66E from the top end of the stacks, with the exception of the stack 45, are pulled down or moved into position by an operator from their initial position and twisted through 360° as indicated at 97 and engaged into the clamping arrangement of the splicing jig.

A moving splicing element 98 of the splicing jig is operated to scan across the adjacent ends 66D and 66E to provide a splicing action.

Splicing can be affected by various techniques including heat sealing and sewing. Sewn splices can be effected by the machine as described hereinafter.

The necessity for a twist and the arrangement of the ends is as described in the above identified application so that no further description will be added here.

With the splicing completed, the splicing jig is removed from a position which could interfere with the unfolding action and then the unfolding action is completed as illustrated schematically where each stack in turn from the stack 45 through to the stack 50 is unfolded and the strip material applied onto a conveyor 99.

It is preferable in this arrangement that the stacks be stored and located in a supply room separate from the end use machine on which the strip is to be employed. The strip can therefore be carried over a relatively long distance on the conveyor 99 from a supply room to a separate room where the end use machines are located.

A suitable sewing device for forming spliced ends in the manner shown is manufactured and sold by Elcu Sud Impianti SRL of Milano Italy known as the AAT2000 Butt End Sewing Machine or the TC105 Butt End Sewing Machine. This machine is commercially available and the details of it are available to one skilled in the art so that the details of the machine are not described herein and the details of the stitches formed by the machine or also not described herein.

However the above machine has not been utilized for absorbent products of the type with which the present invention is primarily concerned and is generally provided for attachment of fabrics.

In order to achieve an effective splice in the above situation it is necessary to ensure that the ends are square to the length of the strip and that the cutting action is effected along a line at right angles to the strip. It is also necessary to ensure that the stitches are arranged at a distance sufficient from the ends of the strip to provide sufficient material to give the strength required to accommodate the forces during handling of the strip. A distance of the order of 0.25 to 0.4 inches is generally acceptable.

Figure 13:
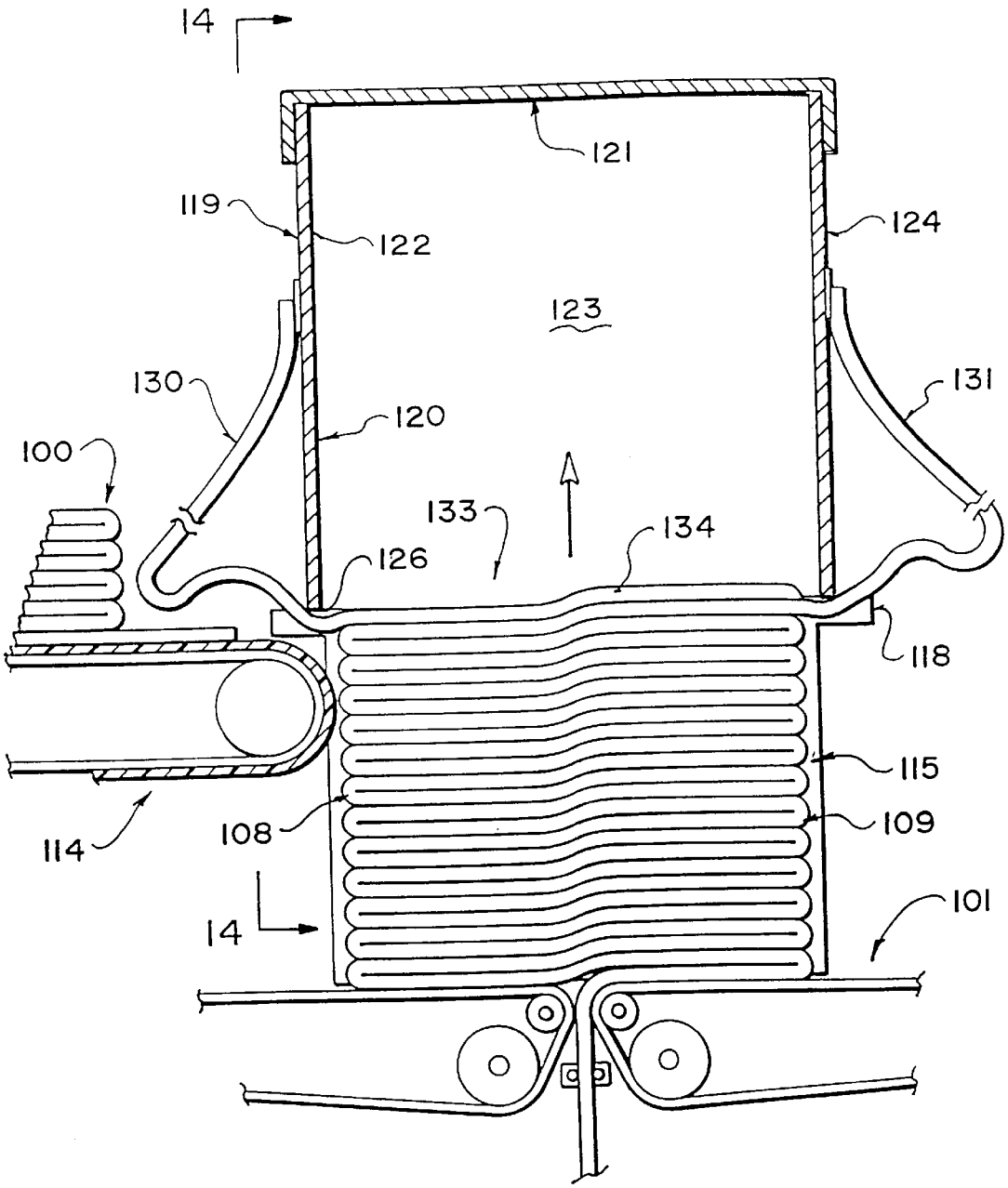
FIG. 13 is a vertical cross sectional view of the folding arrangement of FIG. 1 in which the flexible bag container is replaced by a rigid container having four side walls and an and wall.
Figure 14:
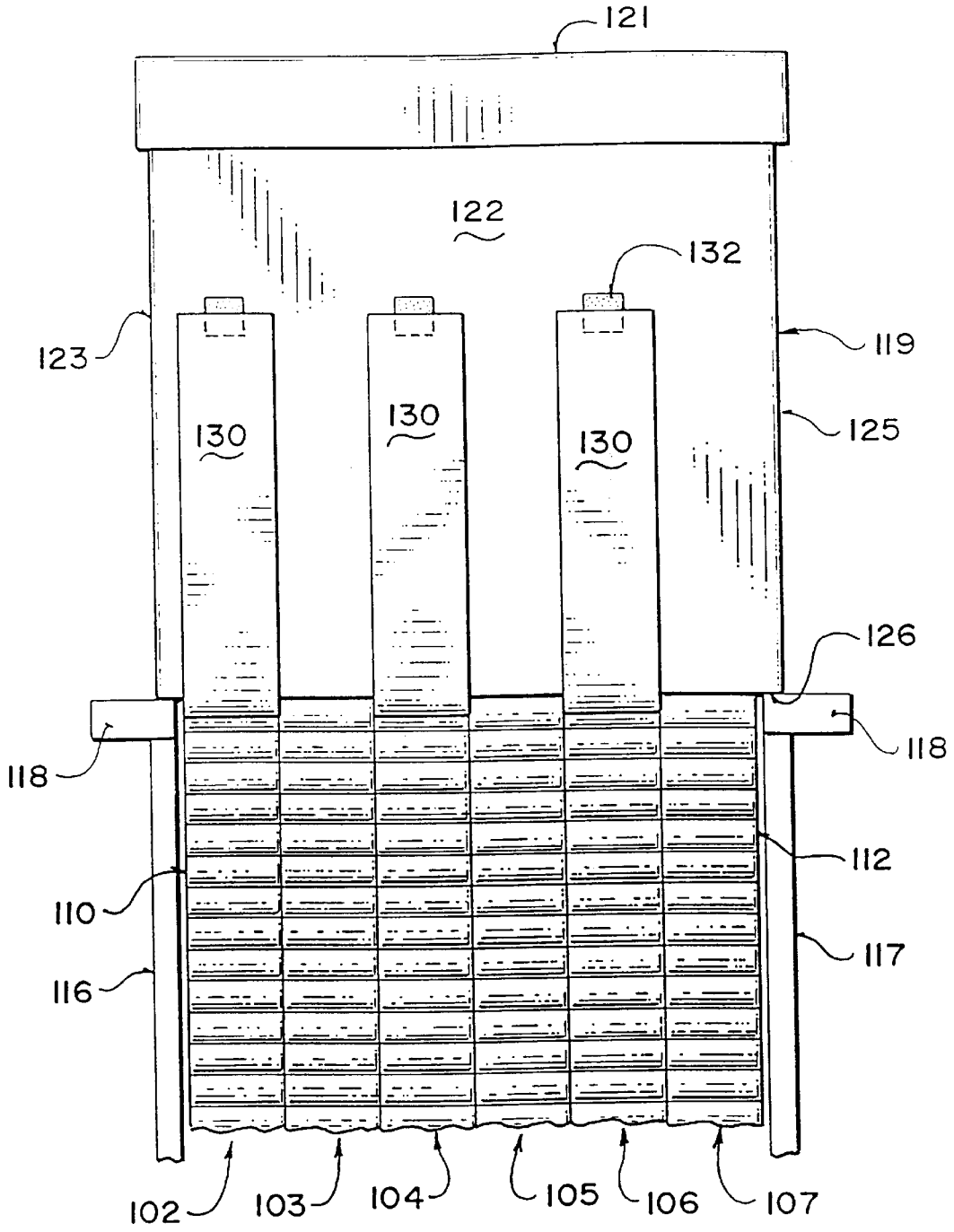
FIG. 14 is a view along the lines 14—14 of FIG. 13.
Figure 15:
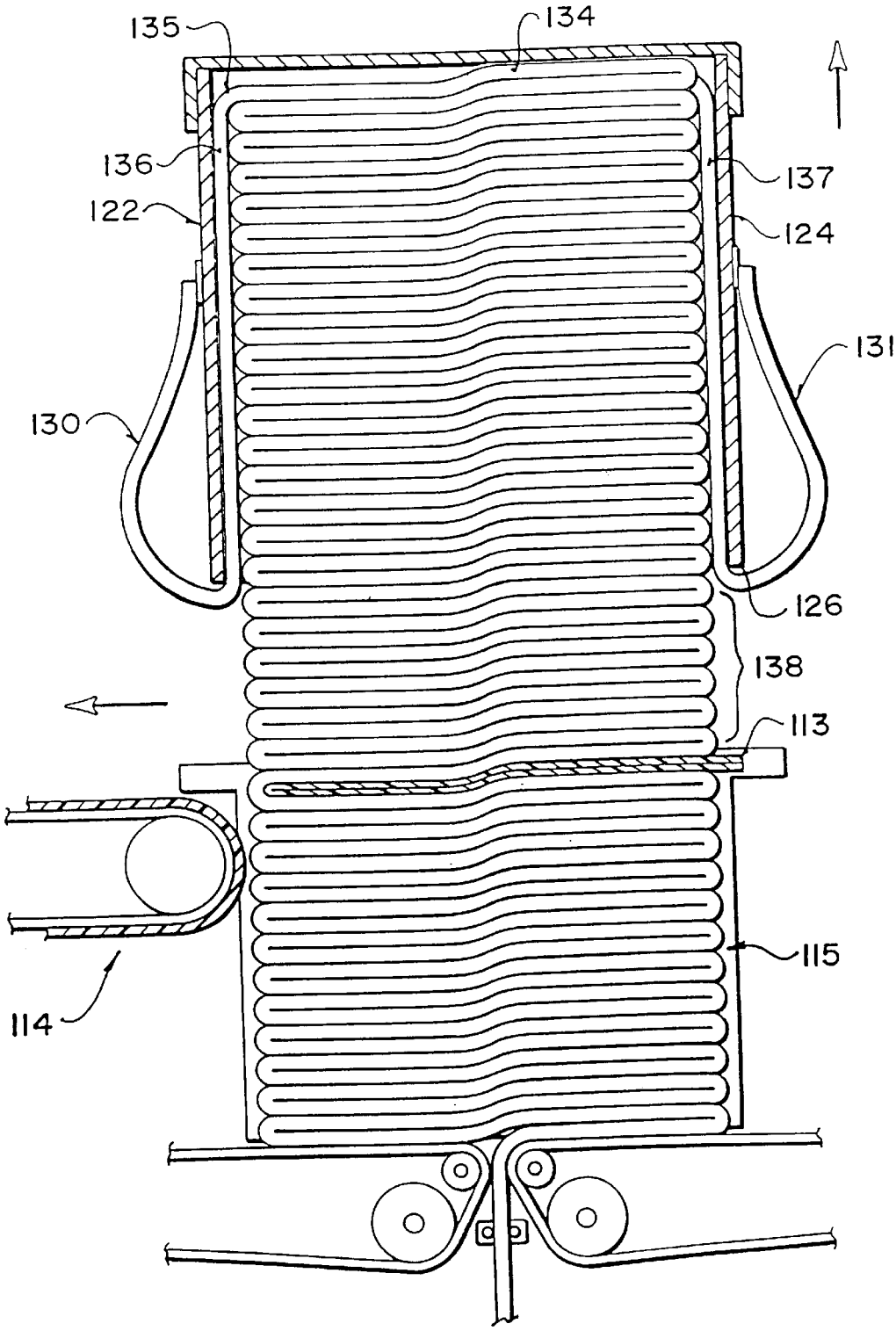
FIG. 15 is a cross sectional view similar to that of FIG. 13 showing the building of the package structure to a further step in the process.

As shown in FIGS. 13, 14, and 15, there is provided a strip folding apparatus generally indicated at 101 which is substantially the same as that previously described so that it includes a carriage with a slot in the carriage with the side by side strips passing through the slot to form a plurality of parallel stacks of the strip as best shown in FIG. 14. Thus the stacks include stacks 102 to 107 which are arranged side by side and parallel with the fold lines at fold ends 108 and 109 of the stacks. The outside stacks 102 and 107 have outwardly facing surfaces 110 and 112 defining sides of the package.

As previously described there is provided a slip sheet 113 which allows a package defined by the plurality of stacks to be moved to one side onto a conveyor 114 when the package is built up to a required height as shown in FIG. 15. A bottom accumulation portion of the package defined by the stacks is indicated at 115 which builds up to the level of the conveyor 114 so that the height of the package remains in place after a built package is removed onto the conveyor to apply pressure onto the carriage.

The sides 110 and 112 are confined by a pair of vertical side walls 116 and 117 to hold the stacks side by side as the package is built. At the top of the side walls 116 and 117 is provided a shelf structure 118 for supporting a container or box 119. The container comprises a sleeve portion 120 and a closed end wall 121. The sleeve portion is defined by four rigid walls 122, 123, 124 and 125. These walls are arranged mutually at right angles to define a rectangular container for receiving the rectangular package defined by the plurality of stacks being formed by the folding apparatus 101. The walls 122 to 125 define a top edge 126 which lies at a common horizontal height so that the top edge of the walls 122 and 124, with the container inverted, have the top edge sitting on the shelf 118.

The process of building the package is shown in FIG. 13, with a package 100 just having been removed on the slip sheet 113 and at the stage of the commencement of the building of the next package.

In a first step of operation, the strips 130 and 131 at the top of the accumulated section 115 are pulled out in alternate directions to form splice tail portions. Thus the strips 130 of the stacks 102, 104 and 108 are pulled out to the left and the strips 131 of the stacks 103, 105 and 107 are pulled out to the right. The strips are pulled out to a significant length to provide the splice tail portion of a sufficient length as described hereinafter. The container is inverted so that the edge 126 faces downwardly and the container thus defines an open mouth 133 facing downwardly onto the top of the accumulated section 115.

The strips are temporarily tacked to the side of the container for storage so that the strips 130 are attached by an adhesive patch 132 to the side wall 122. Symmetrically the strips 131 are tacked to the side wall 124. The side walls 123 and 125 rest on the respective portion of the shelf 118 so that the strip portions 130 and 131 extend underneath the exposed top edge of the walls 122 and 124 respectively. The container may be held in place by suitable side walls or bracing (not shown) so that it remains in position with the side walls aligned with the respective sides and fold ends of the package structure.

To provide improved support of the container and improved control of the tails 130 and 131, the support shelf 118 may support each of the four side walls of the container. However those parts of the shelf at the side walls 122 and 124 may include cut outs each for receiving a respective one of the tails to pass through the cut out thus avoiding the tails being pinched underneath the container.

With the container thus located in place as shown in FIG. 13, the building of the stacks continues by the movement of the carriage as previously described. As the package defined by the stacks is dimensioned so that the package is a loose fit within the container, the building of the package initially causes the package structure to be fed through the open mouth 133 so that the top strips of the stacks move upwardly into the container as more strips are applied to the bottom of the stacks.

As the top strips 134 move upwardly, these strips pull on the strip portions 130 and 131 so that those strip portions are pulled upwardly to lie alongside the fold ends of the respective stacks. As there is sufficient slack in the strip portions 130 and 131, the strip portions are pulled upwardly until the end of the strip portion which is connected to the respective top strip portion 134 which is the top 121 of the container. Thus as shown in FIG. 15, the top strip portion connects at 135 to a length 136 of the portion 130 with the length 136 extending along the side wall 122. Symmetrically, the portion 131 defines a length 137 extending along the side wall 124.

As further shown in FIG. 15, the building of the stacks continues after the stacks fill the container so that the container is then pushed upwardly until a portion 136 of the package is built which extends from the top of the conveyor 114 to the edge 126 of the container. This height of the portion 138 will vary depending upon requirements and the particular material to be packaged as discussed in more detail hereinafter.

When the package structure reaches the position shown in FIG. 15 where the container is filled and the portion 138 is built to the required height, the package is moved on the slip sheet 113 as previously described onto the conveyor 114 and away from the accumulated section 115 of the package. This movement allows the further package to be built while further processing of the first package continues.

Figure 16:
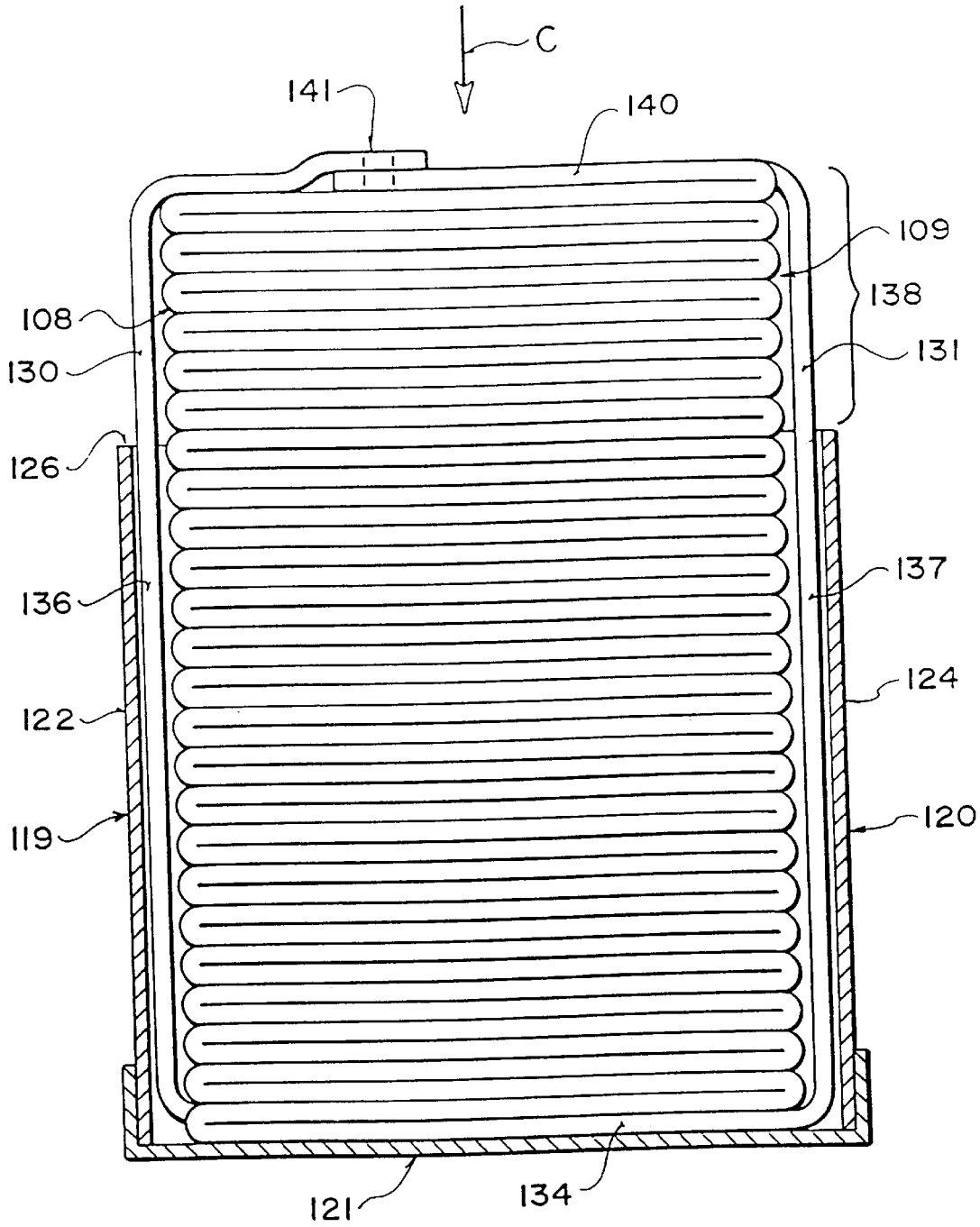
FIG. 16 is a vertical cross sectional view through the package of FIG. 15 in a subsequent step of the process.

With the package moved onto the conveyor, conventional material handling equipment is used to invert the package structure as shown in FIG. 16 so that the end wall 121 becomes the bottom of the container and the sleeve portion 120 of the container stands upwardly to the top edge 126 of the side walls 122 to 125. In this position the portion 138 stands up above the top edge 126 of the container to the required height. With the package in this condition, the portions 130 of the stacks 102, 104 and 106 are connected to a top portion 140 of the next adjacent stacks 103, 105 and 107 respectively by a splice indicated schematically at 141. Thus the strip portion 130 extends from one end strip portion which is at this time at the bottom of the stacks, 102, 104, 106 to a second end strip portion of the next adjacent stacks 103, 105, and 107 with a second end strip portions at this time being at the top of the package structure.

It will of course be appreciated that the package structure can be rotated and inverted so that an element which is temporarily at the top may later be moved to the bottom and vice versa. The terms "top" and "bottom" when used herein are not therefore intended to refer to an element which is necessarily always at the top or bottom in any particular position of processing of the package structures.

Symmetrically, the strip portions 131 are connected to top end strip portions 140 of the stacks 102, 104 and 106 respectively.

It will of course be appreciated that one end strip forms a lead end for connection to a machine for use of the strip and the strip at the opposite corner of the package is a tail end strip for connection to a next package. Therefore one of the connections is not made depending upon whether the strips move left or right or right to left in the unfolding operation.

It will be noted that the length of the strip portions 130 and 131 which define splice tail portions are arranged in the initial pulling of those splice tail portions at a position shown in FIG. 13 to provide sufficient length to extend along the full height of the package in its uncompressed condition and to provide a splice to the top strip portion.

The splice 141 as shown in FIG. 16 is located on the top of the package that is on the top surface containing the second end strip portions 140. It is most convenient to place the splice at this position since that surface is horizontal during the splicing process which makes the spike accessible for locating a jig on the top horizontal surface to simultaneously effect all of the splices.

However it is also possible that the splices can be made at the fold ends 108 and 109 in that portion 138 of the stacks which projects above the stack 126.

It will be appreciated that the package structure as shown in FIG. 16 is uncompressed apart from the weight of the strip portion since no external compressive force has been applied. In this condition known as the "uncompressed" or "rest" condition of the package structure, the stacks include the portion 138 which projects above the top edge 126. The height of this portion is selected in dependence upon the proportion of compression which is required for this particular material to be packaged. The amount of compression can vary from a low level of the order of 10 percent up to as much as 90 percent depending upon the compressibility of the material.

After the splice is completed, a top cover 142 is applied onto the top of the stacks and the package is compressed as indicated at C by a suitable mechanical compression member which applies a force to the top surface of each of the stacks compressing the stacks downwardly until the stacks reach the height of a top edge 126. Thus as shown in FIG. 17 the package is completely closed by the rigid container defined by the sleeve portion 120, the end cover 121 which is now at the bottom of the structure and the end cover 142 which is now at the top of the structure.

The package is maintained closed by a wrapped layer 144 of strapping material of a conventional type. The strapping material can be individual wrapping straps or can be a shrink wrap film material.

Figure 17:
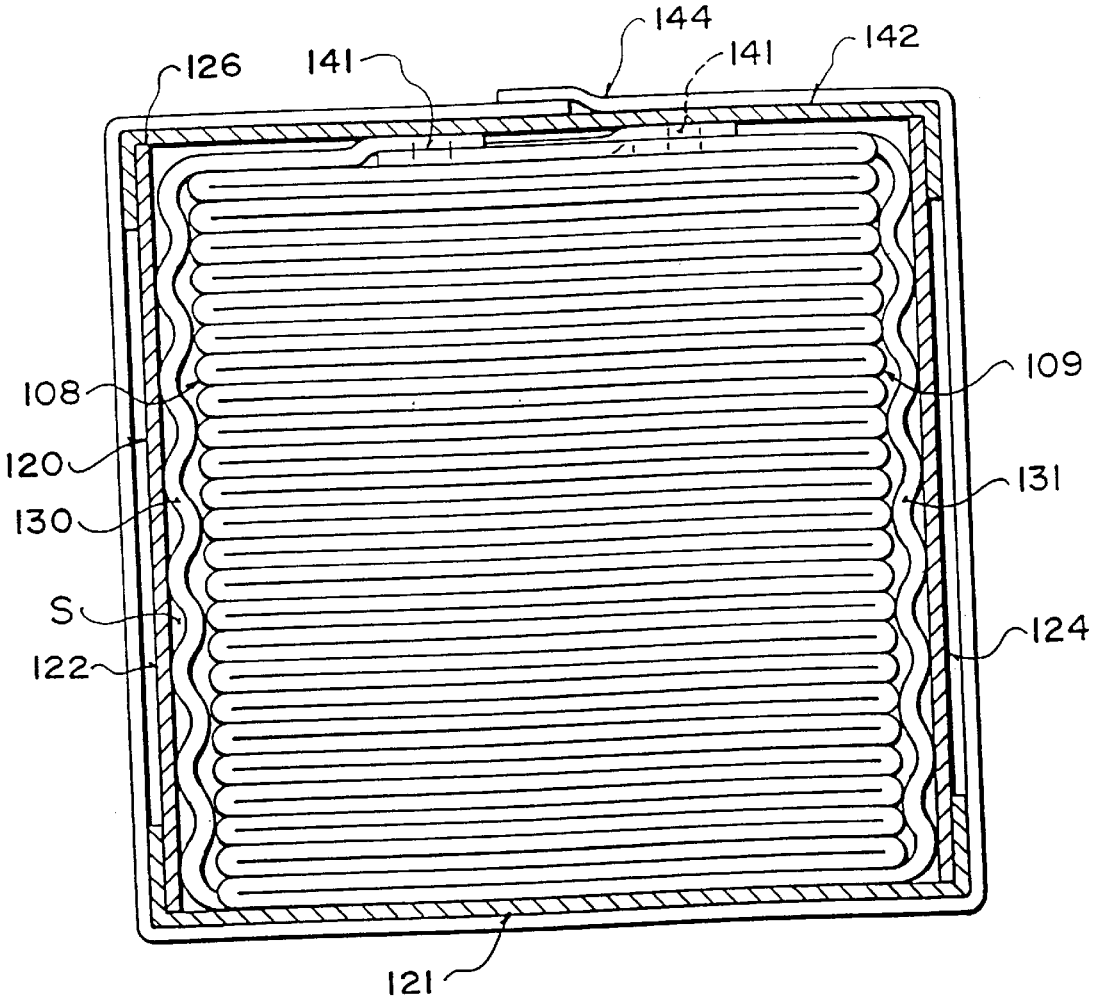
FIG. 17 is a vertical cross sectional view through the package of FIG. 16 in a finished condition for transportation.

As shown in FIG. 17, the fold ends 108 and 109 are spaced from the respective side wall 122 and 124 of the container by a space S which is sufficient to receive the respective splice tail portion 130 and 131 in loose condition without compression. Thus during compression of the package structure, the splice tail portion 130, 131 becomes loose in its longitudinal direction since is length is greater than the height of the package after compression. This loose length is accommodated in the space S by falling in loose condition with crinkling or folding to take up the slack. In practice the space S is in the range 0.5 to 1.0 inches which is sufficient to accommodate the loose splice tail portions without any compression on those portions while maximising the amount of material within the container.

In the arrangement where the splices on the top of the package, the loose splice tail portion is free from any splices so that it is unlikely to bind or trap in the container when the package structure is released from compression for unfolding after transportation and storage.

This arrangement containing the splice tail portions between the box wall and the fold ends ensures that the tail is maintained without pressure which could otherwise cause wrinkling or damage but avoids the necessity for a manual folding and neatening of the tail thus reducing cost for labor.

In some circumstances where for example the package is to be transported in adverse conditions, the box may be covered by a vacuum bag.

It will be appreciated from the above that the container may be a bag or a box depending upon circumstances or the choice of the end user. The bag or box are therefore equivalent structures and may be yet further replaced by alternative packaging constructions.

The side walls of the box are generally and preferably formed of cardboard since this is readily available, provides sufficient stiffness and can to readily disposed of or recycled. However other material may be used. The box when formed of such material is rigid in the sense that it normally retains its shape but it is generally not necessary that the box be maintained rectangular with flat sides in all circumstances and all loads since the material for such a requirement for rigidity would in most cases be prohibitive in price and weight it is generally necessary that the box provide sufficient stiffness to protect the contents during normal transport and storage conditions. In the event that the compressive loading from the package tends to bow the box at the top and bottom, it is possible to provide corner members which act as supports to allow stacking of further containers one on the next.

In some embodiments particularly where the material to be packaged will not accept compression, the package may be built up to a height only slightly above the top edge of the container. Thus the amount of force applied to close the container is only sufficient to apply some slight pressure to the strip portions to hold the structure intact without compressing individual strip portions. Otherwise the method of formation and the finished package are identical to that shown in FIGS. 13 to 17.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

What is claimed is:

1. A package comprising:

a strip having a first side edge, a second side edge, a first surface and a second surface;

a plurality of stacks of the strip;

in each stack the strip being folded repeatedly back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions of each stack being arranged to form a plurality of first fold lines at one fold end of the stack and a plurality of second fold lines at an opposed fold end of the stack;

the strip portions of each stack being arranged such that the first surface of each strip portion lies directly in contact with the first surface of one next adjacent strip portion and such that the second surface of each strip portion lies directly in contact with the second surface of the other next adjacent strip portion;

the strip portion of each stack being arranged with the first side edges thereof lying directly on top of and aligned with the first side edges of others of the strip portions of the stack and with the second side edges thereof lying directly on top of and aligned with the second side edges of others of the strip portions of the stack;

the strip portions of each stack being continuous through the stack between a bottom strip portion and a top strip portion;

the plurality of stacks being arranged side by side with the side edges of the strip portions of each stack adjacent the side edges of a next adjacent stack;

the plurality of stacks thus defining two fold ends of the package containing the fold ends of the stacks and two sides of the package defined by outwardly facing sides of two outermost stacks;

each stack having a splice tail portion extending from a bottom end strip portion of the stack and spliced to a top end strip portion of a next adjacent stack with each splice tail portion extending along one of the fold ends of the stack;

the package being contained within a rectangular container having four rigid side walls each adjacent a respective one of the two sides and the two fold ends of the package;

the stacks having an uncompressed height greater than that of the container such that, when uncompressed, a portion of the stacks is exposed above a top edge of the container the stacks being compressed in a direction at right angles to the surfaces of the strip portions such that the height of the stacks is reduced from the uncompressed height to a compressed height equal to the height of the container and such that the splice tail portions thus are loose;

said one fold end of the stack being spaced from the adjacent rigid wall of the container by a sufficient space to receive the loose splice tail portion therebetween without compression thereof.

2. The package according to claim 1 wherein each of the splices between the splice tail portion and the top strip portion is arranged either at the top end of the stacks such that the loose tail portion is free from a splice or in the portion of the stacks which is exposed above the top edge of the container when the stacks are uncompressed.

3. The package according to claim 1 wherein each of the splices, between the splice tail portion and the top strip portion is arranged at the top end of the stacks such that the loose splice tail portion is free from the splice.

4. The package according to claim 1 wherein the splice tail portions for alternate stacks are arranged at alternate fold ends of the package.

5. The package according to claim 1 wherein the container comprises a preformed structure including a sleeve portion defining said four rigid walls and a bottom wall.

6. The package according to claim 5 wherein the container is closed by a top cover and wherein the package is maintained compressed by a strapping wrapped around the container and over the top cover.

7. The package according to claim 1 wherein the strip is compressible and wherein the amount of compression is sufficient to compress the thickness of each strip portion of each stack.

8. A package comprising:

a strip having a first side edge, a second side edge, a first surface and a second surface;

a plurality of stacks of the strip; in each stack the strip being folded repeatedly back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions of each stack being arranged to form a plurality of first fold lines at one fold end of to stack and a plurality of second fold lines at an opposed fold end of the stack;

the strip portions of each stack being arranged such that the find surface of each strip portion lies directly in contact with in contact with the first surface of one next adjacent strip portion and such that the second surface of each strip portion lies directly in contact with the second surface of the other next adjacent strip portion;

the strip portions of each stack being arranged with the first side edges thereof lying directly on top of and aligned with the first side edges of others of the strip portions of the stack and with the second side edges hereof lying direly on top of and aligned with the second side edges of others of the strip portions of the stack;

the strip portions of each stack being continuous through the stack between a bottom strip portion and a top strip portion;

the plurality of stacks being arranged side by side with the side edges of the strip portions of the strip portions of each stack adjacent the side edges of a next adjacent stack;

the plurality of stacks thus defining two fold ends of the package containing the fold ends of the stack and two sides of the package defined by outwardly facing sides of two outermost stacks;

each stack having a splice tail portion extending from a bottom end strip portion of the stack and spliced to a top end strip portion of a next adjacent stack with splice tail portion extending along one of the fold ends of the stack;

the package being contained within a container including a sleeve portion defining upstanding four walls with a top edge and a bottom wall, such theft each of the four walls lies adjacent a respective one of the two sides and the two fold ends of the package, together with a cover portion covering the top edge;

the stacks having an uncompressed height greater than that of container such that, when uncompressed, a portion of the stacks is exposed above a top edge of the four walls of the container;

the stacks being compressed in a direction at right angles to the surfaces of the strip portions such that the height of the stacks is reduced from the uncompressed height to a compressed height equal to the height of the container;

each of the splices between the splice tail portion and the top strip portion being arranged either at the top end of the stacks such that the loose splice tail portion is free from a splice or in the portion of the stacks which is exposed above the top edge of the container when the stacks are uncompressed; and wherein when the stacks are in a compressed state within the container, the loose splice tail is arranged in the container in an uncompressed condition along side the stacks.

9. The package according to claim 8 wherein each of the splices between the splice tail portion and the top strip portion is arranged at the top end of the stacks such that the splice tail portion is free from a splice.

10. The package according to claim 8 wherein the splice tail portions for alternate stacks are arranged at alternate fold ends of the package.

11. The package according to claim 8 wherein the strip is compressible and wherein the amount of compression is sufficient to compress the thickness of each strip portion of each stack.

12. The package according to claim 8 wherein the sleeve portion of the container including the four walls and the bottom wall defines a pre-formed structure.

13. The package according to claim 12 wherein the four walls and the bottom wall are rigid.

14. A package comprising:

a strip having a first side edge, a second side edge, a first surface and a second surface;

a plurality of stacks of the strip;

in each stack the strip being folded repeatedly back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions of each stack being arranged to form a plurality of first fold lines at one fold end of the stack and a plurality of second fold lines at an opposed fold end of the stack;

the strip portions of each stack being arranged such that the first surface of each strip portion lies directly in contact with the first surface of one next adjacent strip portion and such that the second surface of each strip portion lies directly in contact with the second surface of the other next adjacent strip portion;

the strip portions of each stack being arranged with the first side edges thereof lying directly on top of and aligned with the fist side edges of others of the strip portions of the stack and with the second side edges thereof lying directly on top of and aligned with the second side edges of others of the strip portions of the stack;

the strip portions of each stack being continuous through the stack between a bottom strip portion and a top strip portions;

the plurality of stacks being arranged side by side with the side edges of the strip portions of each stack adjacent the sides edges of a next adjacent stack;

the plurality of stacks thus defining two fold ends of the package containing the fold ends of the stacks and two sides of the package defined by outwardly facing sides of two outermost stacks;

each stack having a splice tail portion extending from a bottom end strip portion of the stack and spliced to a top end strip portion of a next adjacent stack with the splice tail portion extending along one of the fold ends of the stack;

the package being contained within a container including a sleeve portion defining upstanding four rigid walls with a top edge and a rigid bottom wall, such that each of the four walls lies adjacent a respective one of the two sides and the two fold ends of the package, together with a rigid cover portion covering the top edge;

each of the splices between the splice tall portion and the top strip portion being arranged at the top end of the stacks such that the loose splice tail portion is free from a splice; and wherein when the stacks are in a compressed state within the container, the loose splice tail is arranged in the container in an uncompressed condition along side the stacks.

15. The package according to claim 14 wherein the sleeve portion of the container including the four walls and the bottom wall defines a preformed structure.

16. The package according to claim 14 wherein the sleeve portion of the container including the four walls and the bottom wall defines a preformed structure.

* * * * *